US010427411B2

(12) United States Patent
Kosaka et al.

(10) Patent No.: US 10,427,411 B2
(45) Date of Patent: Oct. 1, 2019

(54) INK-JET PRINTING APPARATUS AND CLEANING METHOD

(71) Applicant: CANON KABUSHIKI KAISHA, Tokyo (JP)

(72) Inventors: Kei Kosaka, Tokyo (JP); Tomoyuki Tenkawa, Matsudo (JP); Monta Matsui, Tokyo (JP); Satoko Yaita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/228,395

(22) Filed: Dec. 20, 2018

(65) Prior Publication Data

US 2019/0118536 A1 Apr. 25, 2019

Related U.S. Application Data

(63) Continuation of application No. 15/659,304, filed on Jul. 25, 2017, now Pat. No. 10,201,977.

(30) Foreign Application Priority Data

Jul. 29, 2016 (JP) ..... 2016-150409

(51) Int. Cl.
*B41J 2/165* (2006.01)

(52) U.S. Cl.
CPC ..... *B41J 2/16532* (2013.01); *B41J 2/16523* (2013.01); *B41J 2/16547* (2013.01); *B41J 2/16508* (2013.01); *B41J 2002/16555* (2013.01); *B41J 2002/16573* (2013.01)

(58) Field of Classification Search
CPC ..... B41J 2/16532; B41J 2/16547; B41J 2/16523; B41J 2002/16573; B41J 2002/16594; B41J 2002/16597; B41J 2002/1853
See application file for complete search history.

(56) References Cited

U.S. PATENT DOCUMENTS 7,294,044 B2 * 11/2007 Ferranti ..... B24B 13/00 252/79.1
2002/0030721 A1 3/2002 Asakawa
2004/0145635 A1 * 7/2004 Ebisawa ..... B41J 2/17509 347/85

(Continued)

*Primary Examiner* — Kristal Feggins
(74) *Attorney, Agent, or Firm* — Canon U.S.A., Inc. IP Division

(57) ABSTRACT

An ink-jet printing apparatus includes a print head having a first discharge port and a second discharge port, a cap, a suction unit connected to the cap for sucking ink from the print head, and a determining unit which determines one to be performed by the print head between a first printing operation using the first and second discharge ports and a second printing operation using the first discharge port only, wherein before the first printing operation, the suction unit is controlled to perform first and second suction operations sucking at different strengths. A storing unit further provided therein stores history information indicating the past performance of that the first printing operation. Before the second printing operation, the suction unit is controlled to perform the first suction operation only and, based on the history information after the printing operation, perform the second suction operation.

10 Claims, 23 Drawing Sheets

(56) References Cited

U.S. PATENT DOCUMENTS

2005/0151800 A1* 7/2005 Kono ..... B41J 2/175
347/85
2005/0253909 A1 11/2005 Usui

* cited by examiner

FIG. 13

| RECORDING MEDIUM | 5pl | 1pl |
|---|---|---|
| PLAIN PAPER | ● | |
| GLOSSY PAPER | ● | ● |

FIG. 14A

| RECORDING MEDIUM / IMAGE QUALITY MODE | DOT ARRANGEMENT |
|---|---|
| PLAN PAPER / NORMAL | A |
| PLAIN PAPER / HIGH | B |
| GLOSSY PAPER / NORMAL | C |
| GLOSSY PAPER / HIGH | D |
| GLOSSY PAPER / HIGHEST | E |

FIG. 14B

| DOT ARRANGEMENT | 5pl | 1pl |
|---|---|---|
| A | ● | |
| B | ● | |
| C | ● | ● |
| D | ● | ● |
| E | ● | ● |

INK-JET PRINTING APPARATUS AND CLEANING METHOD

This application is a Continuation of U.S. patent application Ser. No. 15/659,304 filed Jul. 25, 2017, which claims the benefit of Japanese Patent Application No. 2016-150409 filed Jul. 29, 2016, all of which are hereby incorporated by reference herein in their entirety.

BACKGROUND

Field of the Disclosure

The present Disclosure relates an ink-jet printing apparatus which prints an image by ejecting ink from a print head and a cleaning method therefor.

Description of the Related Art

Japanese Patent Laid-Open No. 2007-296755 discloses an ink-jet printing apparatus including a print head having a nozzle face having a large-discharge port array including a plurality of large nozzles each having a large diameter and a small-discharge port array having a plurality of small nozzles each having a small diameter. The type of nozzles to be used is selected in accordance with a printing mode. Each of the small nozzles has a small discharge port area and exhibits a larger meniscus acting on interfaces of the discharge ports than the large nozzles. Thus, the small nozzles may not sufficiently suck bubbles in a configuration in which the large-discharge port array and the small-discharge port array are covered with a cap to suck bubbles contained ink. Japanese Patent Laid-Open No. 2007-296755 discloses that negative pressure is applied to suck ink and bubbles from the large nozzles and larger negative pressure is then applied to suck them again so that bubbles can be sucked sufficiently from small nozzles.

However, in the configuration of Japanese Patent Laid-Open No. 2007-296755, the suction with larger negative pressure is executed before a printing operation is started even in a printing mode without using small nozzles, requiring time to start a printing operation and making a user wait.

SUMMARY

An ink-jet printing apparatus includes a print head having a discharge port face having a first discharge port configured to eject ink droplets of a first amount and a second discharge port configured to eject ink droplets of a second amount less than the first amount, the print head being configured to perform a printing operation on a recording medium, a cap configured to cover the first discharge port and the second discharge port, a suction unit connected to the cap and configured to suck ink from the print head when the cap covers the discharge port face, a determining unit configured to determine, based on a print instruction, a printing operation to be performed by the print head among a plurality of printing operations including a first printing operation performing printing on a recording medium by using the first discharge port and the second discharge port and a second printing operation performing printing on a recording medium by using the first discharge port without using the second discharge port, a control unit configured to, in a case where the determining unit determines to perform the first printing operation, control the suction unit to perform a first suction operation and a second suction operation before the printing operation, the first printing operation sucking ink at a first strength, the second suction operation sucking ink at a second strength higher than the first strength, and a storing unit configured to store history information indicating that the first printing operation has been performed in the past. In a case where the determining unit determines to perform the second printing operation, the control unit controls the suction unit to perform the first suction operation without performing the second suction operation before the printing operation and controls the suction unit to perform an advance suction operation performing the second suction operation based on the history information after the printing operation completes.

Further features of the present Disclosure will become apparent from the following description of exemplary embodiments with reference to the attached drawings.

BRIEF DESCRIPTION OF THE DRAWINGS

FIG. 13 is a table illustrating a printing mode identifying method based on a recording medium according to the first embodiment of the subject disclosure.

FIGS. 14A and 14B are tables illustrating a printing mode identifying method based on a dot arrangement according to the first embodiment of the subject disclosure.

DESCRIPTION OF THE EMBODIMENTS

Embodiments of an ink-jet printing apparatus according to the present disclosure will be described. It should be understood that configuration elements according to embodiments are given for illustration purpose only and that it is not intended that the scope of the present disclosure is limited thereby. A serial type ink-jet printing apparatus will be exemplarily described herein in which a head configured to eject ink to an intermittently conveyed recording medium is reciprocally moved in a direction intersecting with a recording medium conveying direction for printing. However, the present disclosure is not limited to the serial type ink-jet printing apparatus but is applicable to a line type ink-jet printing apparatus which serially performs printing by using a ling print head. The term "ink" herein collectively refers to liquid such as recording liquid. The term "print" herein refers to not only printing on a two-dimensional object but also printing on a three-dimensional object. The term "nozzle" herein collectively refers to a discharge port, a liquid path communicating thereto, and an element which generates energy to be used for ink ejection. The term "recording medium" herein collectively refers to an object to which liquid is ejected such as paper, cloth, plastic film, a metallic plate, glass, ceramics, wood, and leather. The term "recording medium" further refers to not only a cut sheet but also a roll-shaped continuous sheet.

First Embodiment

Figure 1:
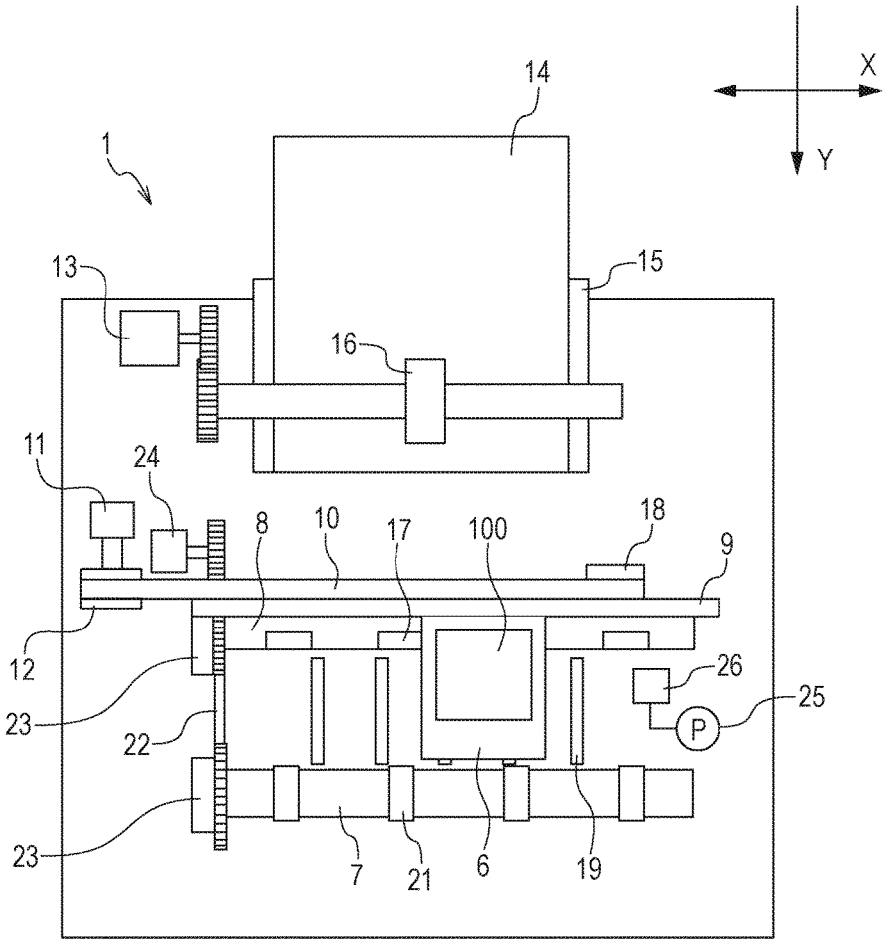
FIG. 1 is a schematic diagram illustrating an ink-jet printing apparatus according to a first embodiment of the subject disclosure.

FIG. 1 is an upper side schematic diagram illustrating an ink-jet printing apparatus (hereinafter, printing apparatus) 1 according to a first embodiment. A print head 102 (see FIG. 2) configured to eject ink is removably mounted to a carriage 6. The print head 102 has a discharge port face 1021 (see FIG. 4) having a plurality of discharge ports 107 (see FIG. 5) causing ink to be ejected as droplets. The print head unit 100 includes the print head 102 and an ink tank 101 to be used for supplying ink to nozzles in the print head 102. The print head 102 has a connector to be used for exchanging a signal for driving the print head 102, and the carriage 6 has a connector holder to be used for transmitting a drive signal to the print head 102 through the connector. The carriage 6 is guided and supported by a guide shaft 9 and can reciprocally move along a direction (X direction in FIG. 4) in which the guide shaft 9 extends. The carriage 6 is driven by a carriage motor 11 through a driving mechanism including a motor pulley 12, a driven pulley 18 and a timing belt 10.

Recording media 14 may be loaded onto an auto sheet feeder 15. In response to a print instruction, a feeding motor 13 is driven so that driving force is transmitted to a pickup roller 16 through gears. Thus, the pickup roller 16 rotates, and the recording media 14 loaded on the auto sheet feeder 15 are separated one by one to be conveyed into the printing apparatus 1. Each of the recording media 14 conveyed into the printing apparatus 1 is conveyed in a Y direction illustrated in FIG. 1 with turning force of the conveying roller 8. The conveying roller 8 rotates with turning force generated by the driven conveying motor 24 and transmitted through the gears. The conveying roller 8 and a pinch roller 17 provided at a position opposing to the conveying roller 8 pinch and convey the recording medium 14. The conveying roller 8 is connected to the discharge roller 7 through a belt member 22. When the conveying roller 8 rotates, the discharge roller 7 also rotates. The discharge roller 7 and a spur roller 21 provided at a position opposing to the discharge roller 7 also pinch and convey the recording medium 14. The rotational amount and rotation speed of the conveying roller 8 are detected by a rotation angle sensor having a code wheel 23 attached to the conveying roller 8 at a slit position, not illustrated, and the conveying roller 8 is controlled based on the information fed back to a control driver for the conveying motor 24.

A platen 19 is placed at a position opposing to the discharge port face 1021 of the print head 102 between the conveying roller 8 and the discharge roller 7. The platen 19 supports the conveyed recording medium 14 from vertically below. The print head 102 is configured to eject ink through the discharge ports (nozzles) 107 while the carriage 6 is moving in the X direction so that an image for one band can be formed on the recording medium 14. After an image for one band is formed on the recording medium 14, the recording medium 14 is conveyed in the Y direction by rotation of the conveying roller 8 and the discharge roller 7 by a predetermined conveyance amount (intermittent conveyance). By repeating the printing operation for one band and the intermittent conveying operation, an image is formed on the entire recording medium 14. The recording medium 14 having an image thereon is discharged by the discharge roller 7 to outside of the printing apparatus 1.

A suction cap (cap) 26 is placed outside a region (print region) where printing is performed on the recording medium 14 within a region where the carriage 6 moves. The cap 26 covers the discharge port face 1021 to prevent the discharge ports 107 from drying while a non-print operation is being performed. The suction pump (pump) 25 sucks ink from the discharge ports 107 in the print head 102 by having negative pressure within the cap 26 when the cap 26 covers the discharge port face 1021. The cap 26 is designed to have a size enough for covering the entire discharge port face 1021. Thus, when the suction is executed, ink can be sucked from all of the discharge ports 107.

Figure 2:
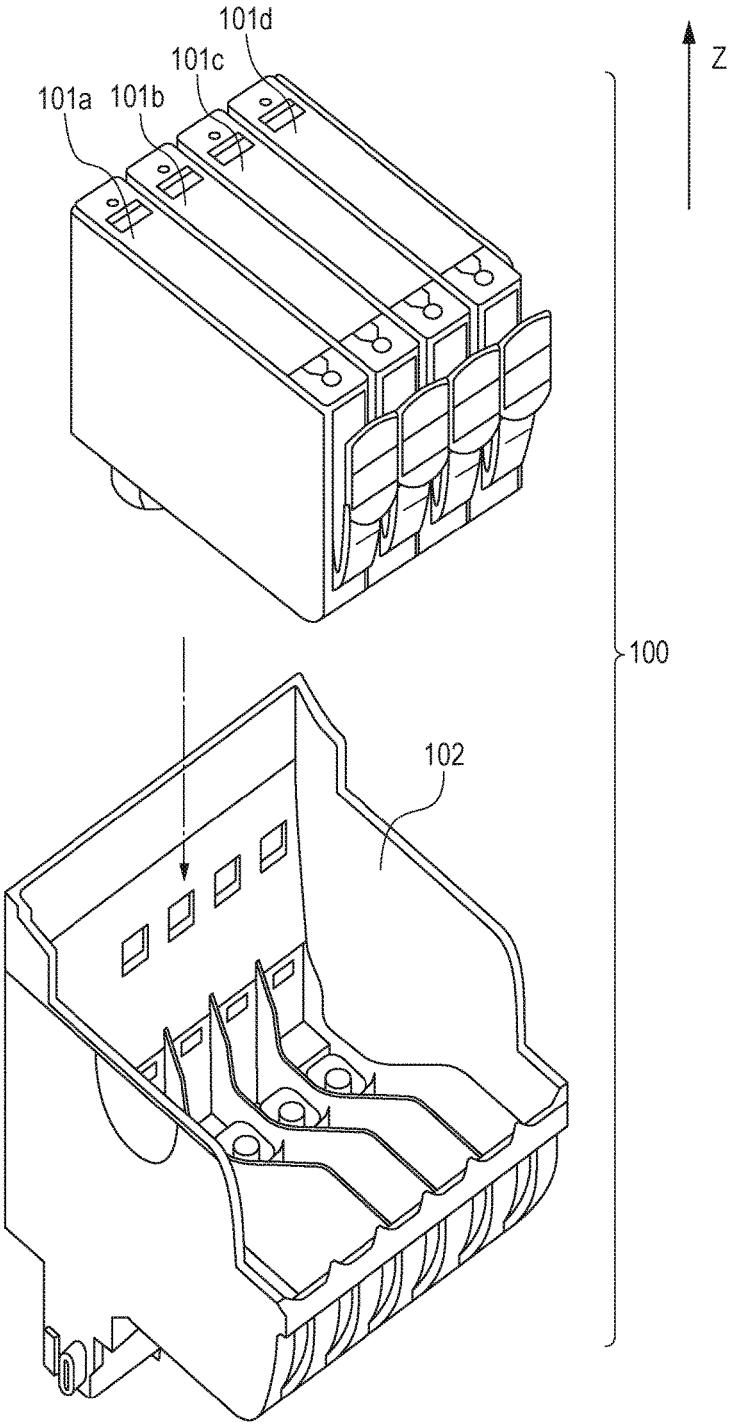
FIG. 2 is a schematic diagram illustrating a print head unit according to the first embodiment of the subject disclosure.

FIG. 2 is a schematic view illustrating the print head unit 100 according to this embodiment. The ink tank 101 containing ink is detachably mounted in the print head 102. According to this embodiment, the ink tank 101 has four of a cyan ink tank 101*a*, a magenta ink tank 101*b*, a yellow ink tank 101*c*, and a black ink tank 101*d*. Though four color inks are used in this embodiment, the present disclosure is not limited thereto. For example, three or fewer color inks may be used, or four or more inks including another color ink may be used. Another color ink may be a gray ink, a pigment black ink, a light cyan ink or the like, for example.

Figure 3:
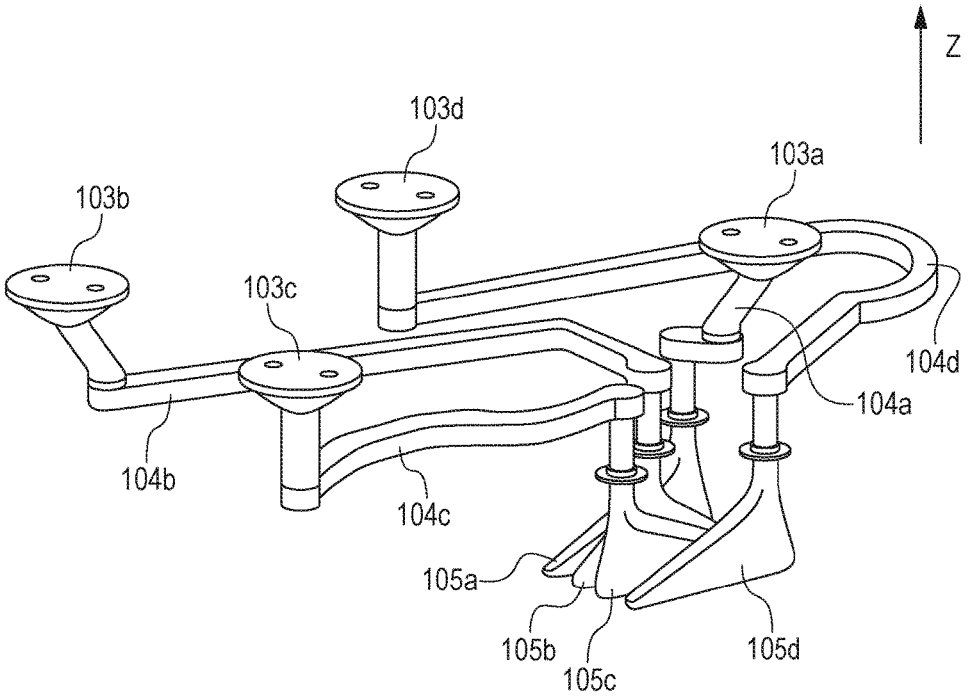
FIG. 3 is a schematic diagram illustrating an ink channel in a print head according to the first embodiment of the subject disclosure.

Next, with reference to FIGS. 3 to 5, a configuration of the print head 102 will be described in detail. FIG. 3 is a schematic diagram illustrating an ink channel in the print head 102. The ink channel in the print head 102 includes a filter unit 103, an ink channel unit 104, and an ink common liquid chamber 105. The filter unit 103, the ink channel unit 104 and the ink common liquid chamber 105 are separately provided for each of four colors of cyan, magenta, yellow, and black. Referring to FIG. 3, the letters "a", "b", "c", and "d" at the ends of references of the units indicate that the units are for cyan, magenta, yellow, and black, respectively. A metallic filter is thermally welded to the filter unit 103. The filter unit 103 is a connection part to the ink tank 101 and has a function of generating capillary force to supply ink from the ink tank 101 and a function of preventing external invasion of dust. The ink channel unit 104 is a channel for supplying ink from the filter unit 103 to a nozzle and communicates with the ink common liquid chamber 105. The ink common liquid chamber 105 has a space inclined at its vertical (Z direction) upper part so that bubbles contained in ink therein can be easily gathered to the vertical upper part.

Figure 4:
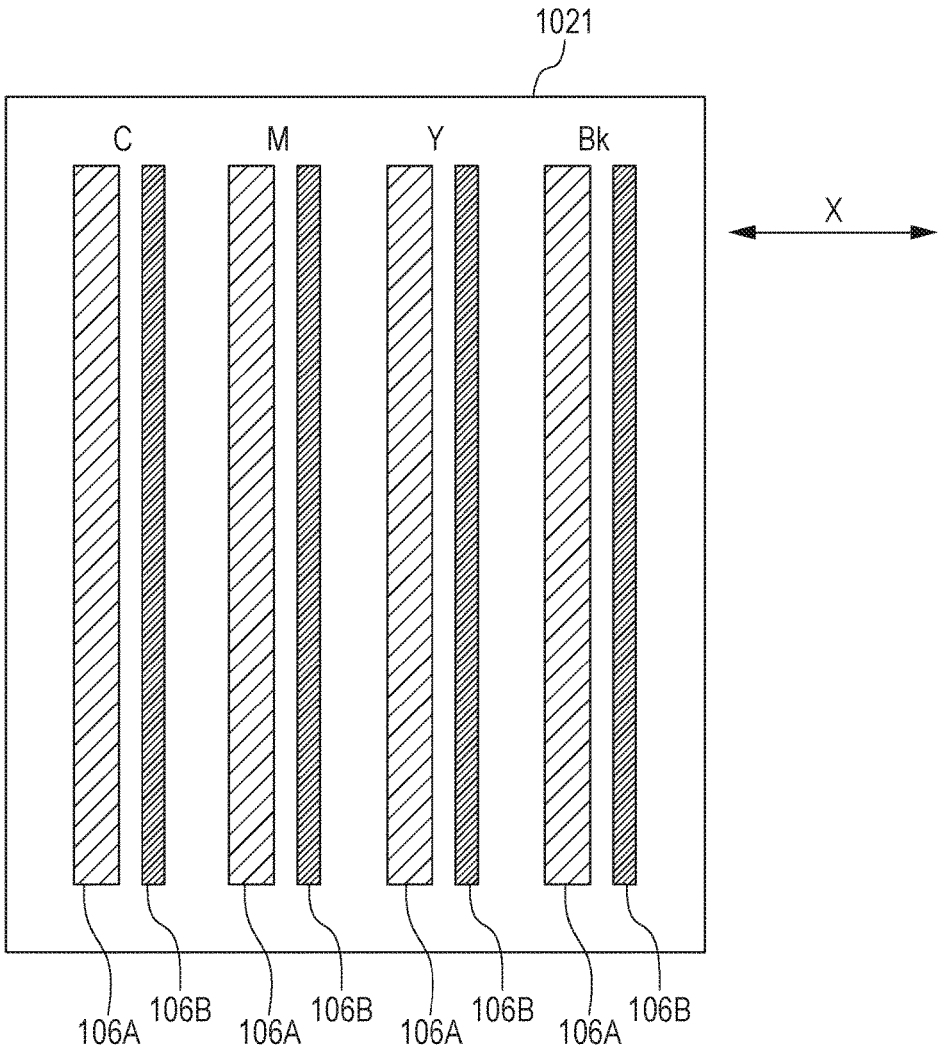
FIG. 4 is a schematic transparent view from the ink channel side, illustrating a discharge port array according to the first embodiment of the subject disclosure.

FIG. 4 is a transparent view of the discharge port face 1021 from the ink channel side (vertical upper part). The discharge port face 1021 has thereon a first discharge port array 106A and a second discharge port array 106B for each of the colors. The first discharge port array 106A has a plurality of first discharge ports 107A, and the second discharge port array 106B has a plurality of second discharge ports 107B each having a smaller diameter (nozzle diameter) than that of the first discharge ports 107. According to this embodiment, 5 pl ink droplets can be ejected from the first discharge port 107A, and 1 pl ink droplets can be ejected from the second discharge port 107B. Hereinafter, each of nozzles provided in the first discharge port array 106A will be called a 5-pl nozzle, and each of nozzles provided in the second discharge port array 106B will be called a 1-pl nozzle. The 5-pl nozzle has a nozzle diameter of approximately 16.4 μm, and the 1-pl nozzle has a nozzle diameter of approximately 9.2 μm. The discharge port face 1021 has thereon a cyan (C) 5-pl nozzle, a cyan (C) 1-pl nozzle, a magenta (M) 5-pl nozzle, and a magenta (M) 1-pl nozzle in order from the left. The discharge port face 1021 further has thereon a yellow (Y) 5-pl nozzle, a yellow (Y) 1-pl nozzle, a black (Bk) 5-pl nozzle, and a black (Bk) 1-pl nozzle. According to this embodiment, 512 5-pl nozzles and 1-pl nozzles are provided for each color at discharge port intervals of 600 dpi in each of the discharge port arrays 106.

Figure 5:
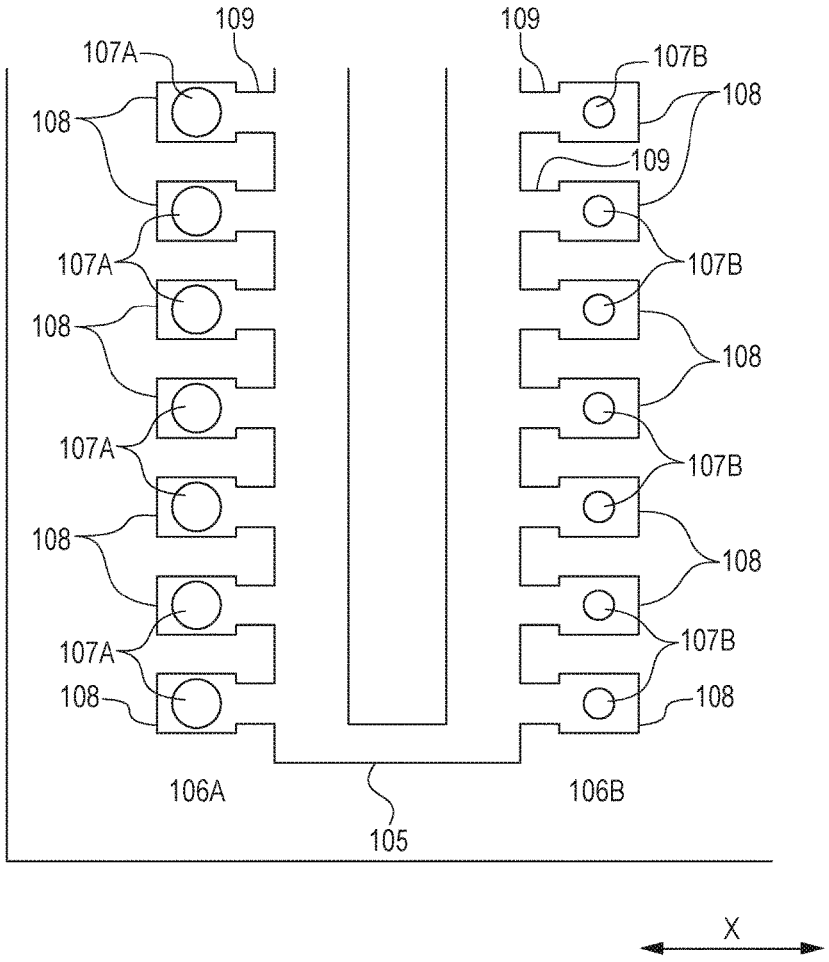
FIG. 5 is a schematic diagram illustrating a partial enlargement of the discharge port array according to the first embodiment of the subject disclosure.

FIG. 5 is a schematic diagram of a partial enlargement of the discharge port array 106 in FIG. 4. Ink is supplied from the ink common liquid chamber 105 positioned between the first discharge port array 106A and the second discharge port array 106B to the discharge ports (nozzles) 107 through an ink introduction portion 9. Each of the nozzles has an ink foaming chamber 108. The print head 102 is an ink-jet print head configured to eject ink by using thermal energy and includes a plurality of electrothermal converters configured to generate thermal energy. In other words, the print head 102 generates thermal energy in response to a pulse signal applied to the electrothermal converters, and the thermal energy causes film boiling of ink in the ink foaming chamber 108. The foaming pressure of the film boiling is used to eject ink through the discharge ports 107.

Figure 6:
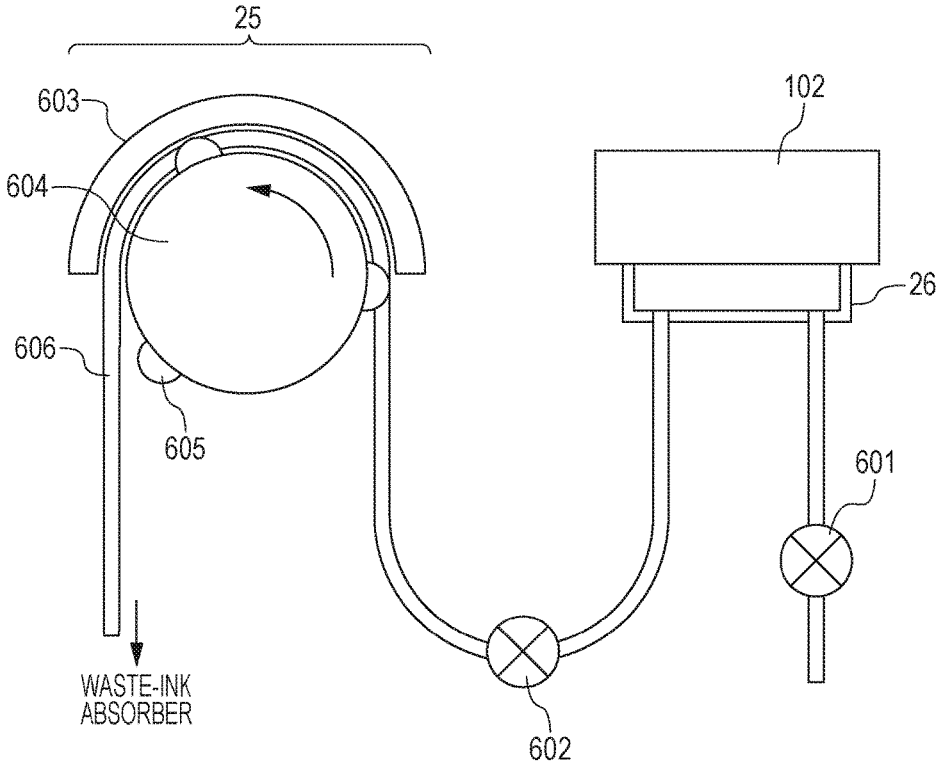
FIG. 6 is a schematic diagram of a suction unit according to the first embodiment of the subject disclosure.

Next, a suction unit according to this embodiment will be described. FIG. 6 is a schematic diagram illustrating a suction unit according to this embodiment. The suction unit includes the cap 26 configured to cover the discharge port face 1021 of the print head 102, a suction tube (or tube) 606 having one end connecting to the cap 26 and the other end connecting to a waste-ink absorber, not illustrated, and a pump 25 provided for the tube 606. The pump 25 has an axis 604 and a plurality of rollers 605 provided on the perimeter of the axis 604. Rotation of the axis 604 in a direction indicated by the illustrated arrow (counter-clockwise in FIG. 6) causes the pump 25 to sequentially compress the tube 606 held by a roller 605 and a guide 603 so that the tube 606 is internally depressurized. As a result, with the cap 26 covering the discharge port face 1021 of the print head 102, negative pressure is caused inside the cap 26 so that normal suction (first suction operation) can be performed which sucks ink from the discharge port array 106 in the print head 102. The suction amount of the suction operation depends on the predefined number of rotations and rotation speed of the roller 605. After the pump 25 is rotated by a predetermined number of rotations, the driving of the pump 25 is stopped. Then, the cap 26 is separated from the discharge port face 1021 (cap open) or when an air release valve 601 provided on an air release path connected to the cap 26 is opened so that the inside of the cap 26 is communicated to the atmosphere.

The suction unit according to this embodiment has a charge valve (on-off valve) 602 in a middle part of the tube 606. The charge valve 602 is disposed between the cap 26 and the pump 25 to switch between a state (open state) in which the channel therebetween is communicated and a state (closed state) in which the channel is not communicated. When the charge valve 602 is changed to a closed state to drive the pump 25 and the axis 604 having the roller 605 is rotated in the direction indicated by the arrow, the inside of the tube 606 between the charge valve 602 and the pump 25 is depressurized so that high negative pressure is generated. The driving of the pump 25 in the state is stopped to change the charge valve 602 to an open state so that a charge suction (second suction operation) can be performed which sucks ink from the discharge port array 106 in the print head 102 through the cap 26. The charge suction uses the charge valve 602 to charge negative pressure to suck. Thus, ink can be sucked from the discharge port array 106 with higher negative pressure than that of normal suction without using the charge valve 602. The charge valve 602 may be an electromagnetic valve or a valve which mechanically presses a tube from viewpoints of cost and size. While the normal suction is being performed, the charge valve 602 has an open state.

Figure 7:
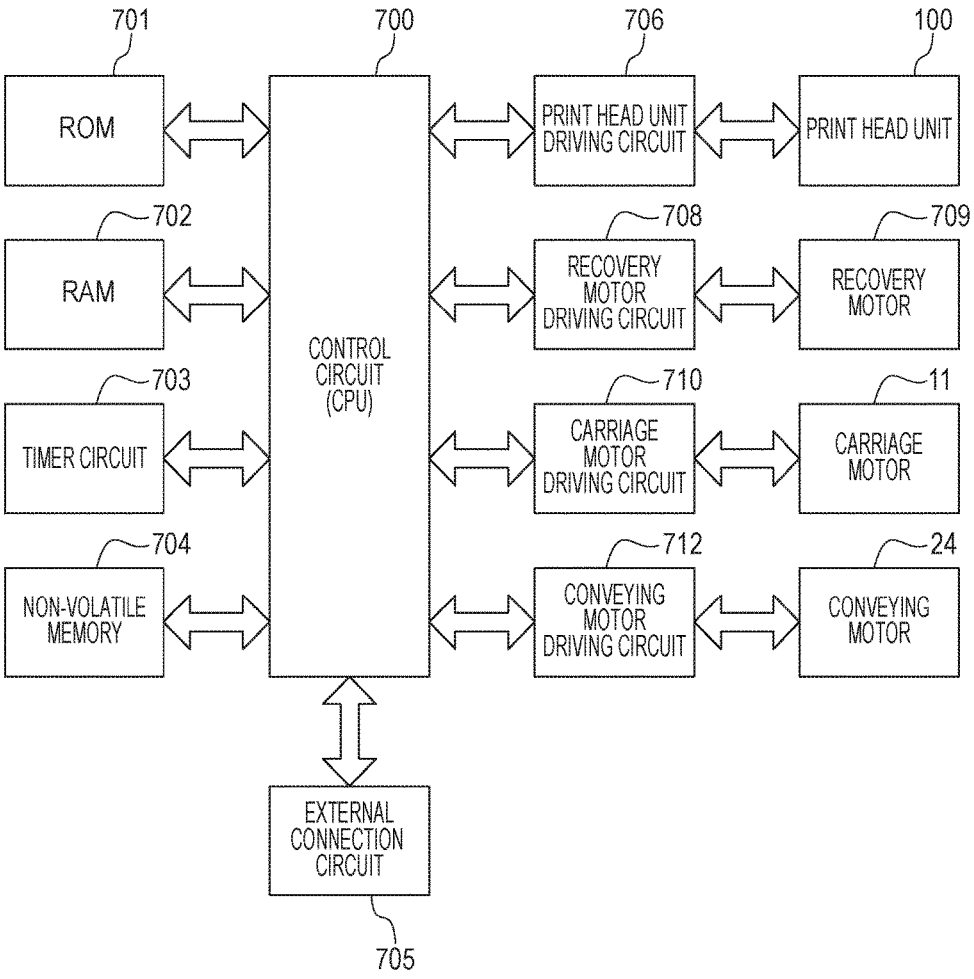
FIG. 7 is a block diagram illustrating a control configuration according to the first embodiment of the subject disclosure.

FIG. 7 is a block diagram illustrating a control configuration according to this embodiment. A ROM 701 is configured to store set values in a control program or in a control to be executed. A RAM 702 is usable for decompressing data for executing a control program, for storing printing data and control instructions, and storing control variables to be used in controls. A timer circuit 703 may be a circuit capable of acquiring information regarding the current clock time or a circuit capable of measuring an elapsed time. A non-volatile memory (storing unit) 704 can store a parameter to be used in a control even when the power supply to the main body is turned off. In a control according to this embodiment, the non-volatile memory (storing unit) 704 is usable for writing and reading a clock time at a starting point of an elapsed time to be calculated. A control circuit (control unit and determining unit) 700 includes a CPU configured to execute a control program stored in the ROM 701 and a control program decompressed in the RAM 702. An external connection circuit 705 is a circuit enabling the control circuit (CPU) 700 to support interfaces and control signals for wired or wireless communication between the main body of the printing apparatus 1 and an external host apparatus. The printing apparatus 1 receives image data (print instruction) to be printed in the printing apparatus 1 from an external host apparatus through the external connection circuit 705. The current clock time may be input to the printing apparatus 1 through the external connection circuit 705.

The control circuit 700 decompresses received image data on the RAM 702. The control circuit 700 further controls driving of the print head unit 100 through the print head unit driving circuit 706 based on data decompressed on the RAM 702. At the same time, the control circuit 700 controls driving of the carriage motor 11 through the carriage motor driving circuit 710. The control circuit 700 controls one printing operation so that ink can be ejected from the print head 102 to a target position on the recording medium 14 while the carriage 6 is moving to form an image for one band on the recording medium 14. The control circuit 700 further controls the conveying motor 24 through the conveying motor driving circuit 712 to intermittently convey the recording medium 14. The control circuit 700 further controls the recovery motor 709 through the recovery motor driving circuit 708 to perform a suction operation (normal suction or charge suction) which sucks a predetermined amount of ink from the print head 102. The recovery motor 709 rotates the axis 604 having the roller 605 in the pump 25 to perform a suction operation. The recovery motor 709 is controlled to perform a capping operation on the discharge port face 1021 with the cap 26 and a wiping operation on the discharge port face 1021 with a wiper, not illustrated. The control circuit 700 further controls driving of the print head unit 100 through the print head unit driving circuit 706 to perform preliminary discharge on the printing cap 26 which ejects a predetermined amount of ink not contributing to printing. The print head 102 in this case is driven in a pattern based on data decompressed on the RAM 702, data on the ROM 701 or data generated in the control circuit 700, similarly to the printing operation.

Next, a recovery operation to be performed according to this embodiment will be described. The printing apparatus 1 is configured to perform a recovery operation (cleaning operation) on the print head 102 including a suction operation for purposes of bubble removal within the print head 102, discharging of adhered ink, ink filling and so on. The recovery operation may be performed in a case where the ink tank 101 is replaced, a case where an elapsed time from the previous recovery operation exceeds a predetermined time, or a case where the discharge amount (number of dots) of ink droplets ejected after the previous recovery operation (after a normal suction operation) is equal to or higher than a predetermined value, for example. According to this embodiment, the three cases will be described. In those cases, a recovery request flag (first flag) is turned on. The information regarding the recovery request flag is stored in the non-volatile memory 704 illustrated in FIG. 7. When the recovery request flag is turned on, a recovery operation is performed at a predetermined time point before a printing operation.

Figure 8:
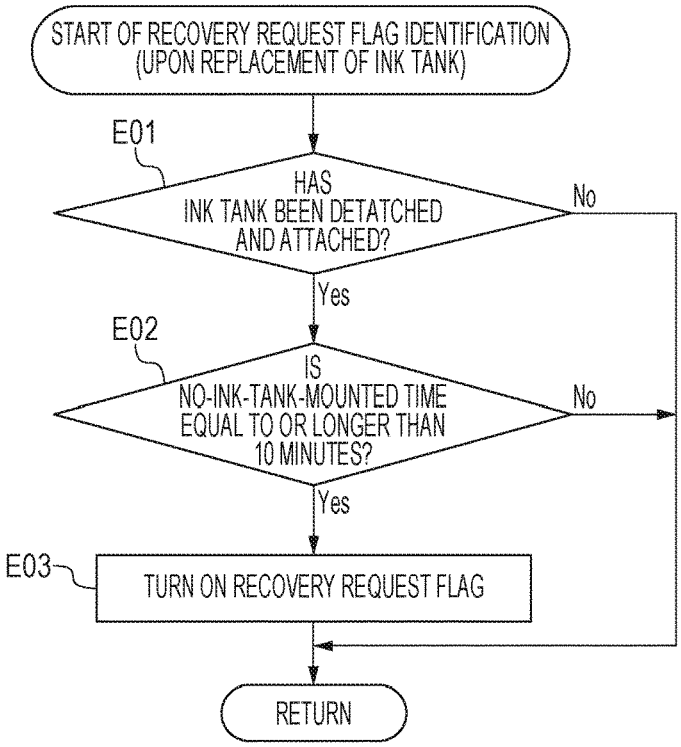
FIG. 8 is a flowchart illustrating a control to turn on a recovery request flag in a case where an ink tank is to be replaced according to the first embodiment of the subject disclosure.

First of all, a control to be performed for turning on the recovery request flag in a case where the ink tank 101 is replaced will be described with reference to FIG. 8. In step E01, the CPU 700 determines whether a user has detached and attached the ink tank 101 or not. If the ink tank 101 has not been detached in step E01, the CPU 700 exits the sequence by keeping the recovery request flag in an OFF state. If the ink tank 101 has been detached and attached in step E01, the processing moves to step E02 where the CPU 700 determines whether the time period from the detachment to the attachment of the ink tank 101 by a user (ink tank detached time period) is equal to or longer than a threshold value or not. FIG. 8 illustrates an example that the threshold value is set to 10 minutes. If it is determined in step E02 that the ink tank detached time period is shorter than 10 minutes, the CPU 700 exits the sequence by keeping the recovery request flag in an OFF state. If it is determined in step E02 that the ink tank detached time period is equal to or longer than 10 minutes, the processing moves to step E03 where the CPU 700 turns on the recovery request flag and exits the sequence.

Figure 9:
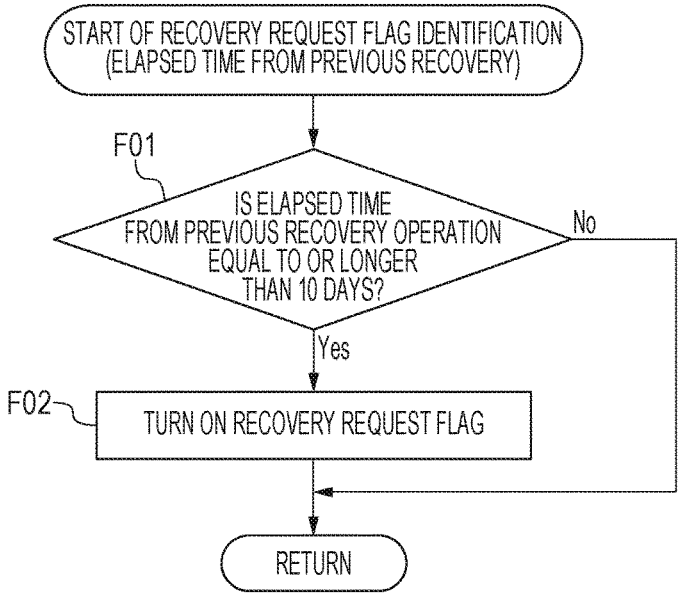
FIG. 9 is a flowchart illustrating a control to turn on the recovery request flag based on an elapsed time from a previous recovery operation according to the first embodiment of the subject disclosure.

Next, a control to turn on the recovery request flag in a case where the elapsed time from the previous recovery operation exceeds a predetermined time will be described with reference to FIG. 9. In step F01, the CPU 700 determines whether the elapsed time from the previous recovery operation is equal to or longer than a threshold value or not. FIG. 9 illustrates a case where a threshold value is 10 days. In a case where it is determined in step F01 that the elapsed time from the previous recovery operation is shorter than 10 days, the CPU 700 exits the sequence without turning on the recovery request flag (or by keeping it off). In a case where it is determined in step F01 that the elapsed time from the previous recovery operation is equal to or longer than 10 days, the processing moves to step F02 where the CPU 700 turns on the recovery request flag and exits the sequence.

Here, the count value for the elapsed time is reset after a recovery operation including a normal suction. In a case where a recovery operation is performed including a charge suction and excluding a normal suction, the counting of the elapsed time is continued without resetting the count value for the elapsed time.

Next, a control to turn on the recovery request flag in a case where the number of dots ejected after the previous recovery operation is equal to or higher than a predetermined value will be described with reference to FIG. 10. In step G01, the CPU 700 acquires the count value (the number of dots) for the ink droplets (dot) ejected from the previous recovery operation in the discharge port arrays for respective colors. Here, Dcount(5 pl)_c indicates the number of dots ejected from a first discharge port array 106A for cyan, and Dcount(1 pl)_c is the number of dots ejected from a second discharge port array 106B for cyan. Dcount(5 pl)_m indicates the number of dots ejected from a first discharge port array 106A for magenta, and Dcount(1 pl)_m indicates the number of dots ejected from a second discharge port array 106B for magenta. Dcount(5 pl)_y indicates the number of dots ejected from a first discharge port array 106A for yellow, and Dcount(1 pl)_y indicates the number of dots ejected from a second discharge port array 106B for yellow. These numbers of dots are stored in the non-volatile memory 704 illustrated in FIG. 7.

Next, in step G02, the CPU 700 determines whether a sum (Dcount(5 pl)_c+Dcount(1 pl)_c) of the numbers of dots ejected from the first discharge port array 106A and second discharge port array 106B for cyan is equal to or higher than a threshold value or not. FIG. 10 illustrates an example where the threshold value is 5.0×10^8. In a case where it is determined in step G02 that the sum of the numbers of dots for cyan is equal to or higher than the threshold value, the processing moves to step G05 where the CPU 700 turns on the recovery request flag and exits the sequence. In a case where it is determined in step G02 that the sum of the numbers of dots for cyan is lower than the threshold value, the CPU 700 in step G03 determines whether a sum(Dcount(5 pl)_m+Dcount(1 pl)_m) of the numbers of dots ejected from the first discharge port array 106A and second discharge port array 106B for magenta is equal to or higher than a threshold value or not. The threshold value here is 5.0×10^8, like that for cyan. In a case where it is determined in step G03 that the sum of the numbers of dots for magenta is equal to or higher than the threshold value, the processing moves to step G05 where the CPU 700 turns on the recovery request flag and exits the sequence. In a case where it is determined in step G03 that sum of the numbers of dots for magenta is lower than the threshold value, the CPU 700 in step G04 whether a sum (Dcount(5 pl)_y+Dcount(1 pl)_y) of the numbers of dots ejected from the first discharge port array 106A and second discharge port array 106B for yellow is equal to or higher than a threshold value or not. The threshold value is 5.0×10^8, like those for cyan and magenta. In a case where it is determined in step G04 that the sum of the numbers of dots for yellow is equal to or higher than the threshold value, the processing moves to step G05 where the CPU 700 turns on the recovery request flag and exits the sequence. In a case where it is determined in step G04 that the sum of the numbers of dots for yellow is lower than the threshold value, the CPU 700 exits the sequence without turning on the recovery request flag (or by keeping it on).

Figure 10:
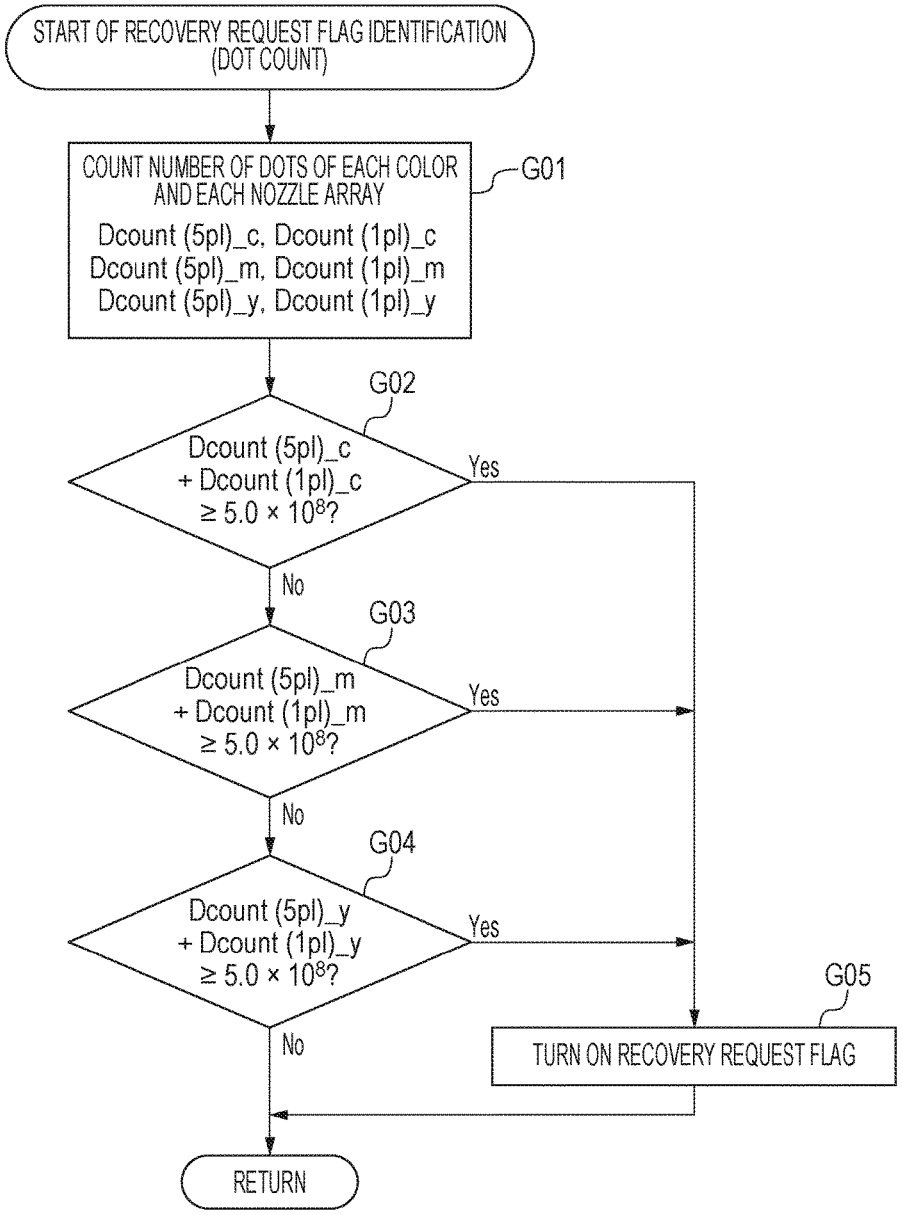
FIG. 10 is a flowchart illustrating a control in a case where the recovery request flag is turned on based on the number of dots according to the first embodiment of the subject disclosure.

The CPU 700 resets the count values for the numbers of dots illustrated in FIG. 10 after a recovery operation is performed including a normal suction and restarts the counting from 0. Because the recovery operation is performed on nozzles for all of the colors, the count values for all of the colors are reset. The dots to be counted may include not only ink droplets ejected by a printing operation but also ink droplets ejected by a preliminary discharge.

Figure 11:
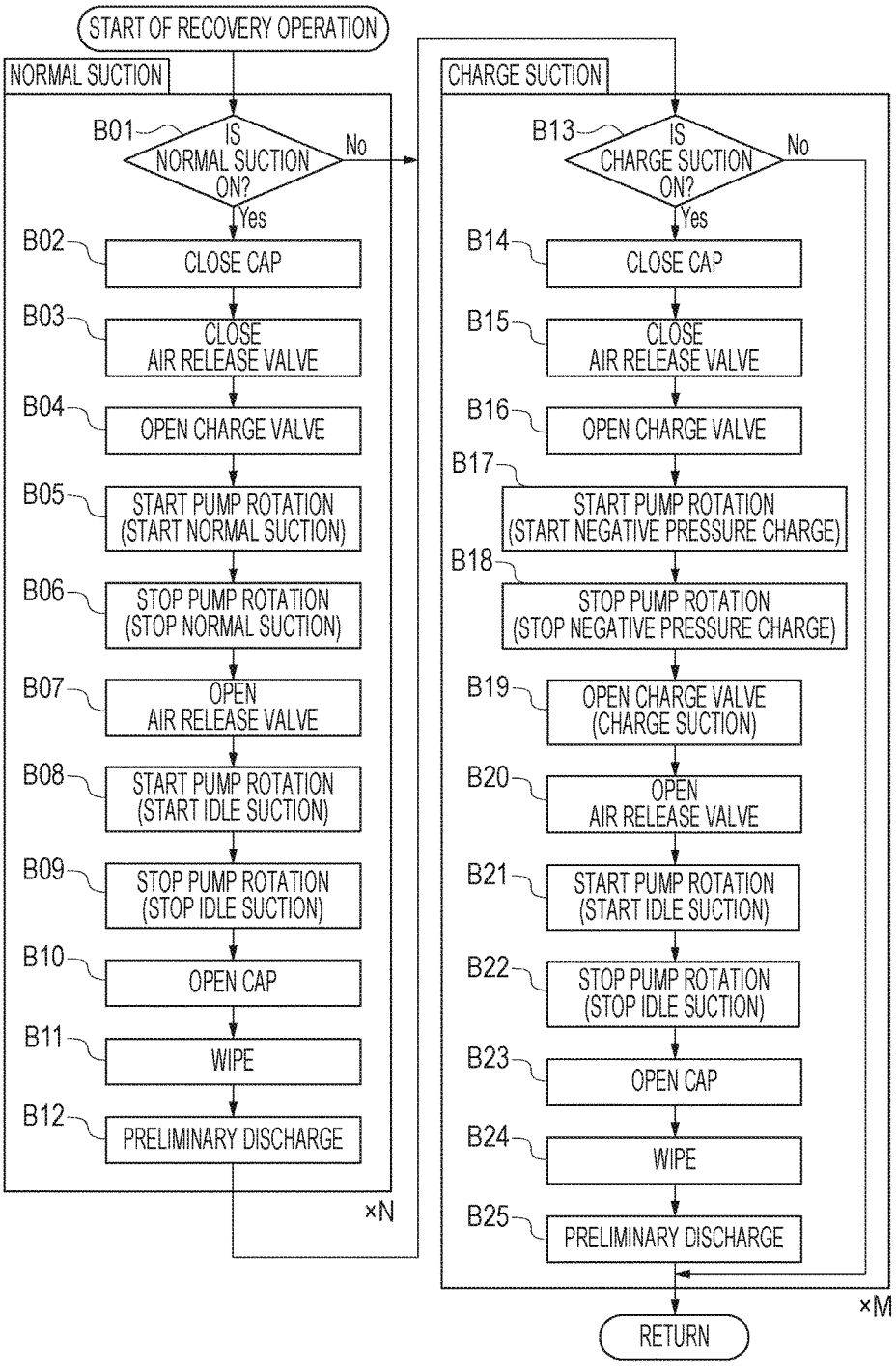
FIG. 11 is a flowchart illustrating a recovery operation according to the first embodiment of the subject disclosure.

FIG. 11 is a flowchart illustrating a recovery operation according to this embodiment. The recovery operation according to this embodiment performs a charge suction subsequently to a normal suction. The term "normal suction" refers to a suction operation without using the charge valve 602 illustrated in FIG. 6, and the term "charge suction" refers to a suction operation using the charge valve 602.

Once the recovery operation starts, the CPU 700 in step B01 determines whether a normal suction execution instruction has an ON state or not. If the normal suction execution instruction has an OFF state, the processing moves to step B13 involving a charge suction. If the normal suction execution instruction has an ON state, the discharge port face 1021 of the print head 102 is covered with the cap 26 in step B02. In step B03, the CPU 700 closes the air release valve 601 to shut off the air release path between the air release valve 601 and the cap 26. Because the normal suction does not use the charge valve 602, the CPU 700 in step B04 opens the charge valve 602. Next, the CPU 700 in step B05 rotates the pump 25 to start a normal suction. After the pump 25 is rotates by a predetermined number of rotations, the rotation of the pump 25 is stopped to finish the normal suction in step B06.

Then, the CPU 700 in step B07 opens the air release valve 601 to cause the inside of the cap 26 to communicate with the atmosphere. In step B08, the CPU 700 rotates the pump 25 again to suck and discharge the ink stayed within the cap 26 (hereinafter, called an idle suction). After rotating the pump 25 by a predetermined number of rotations, the CPU 700 stops the rotation of the pump 25 in step B09 and finishes the idle suction. After that, in step B10, the CPU 700 separates the cap 26 covering the discharge port face 1021 from the print head 102 to acquire a cap open state. After a wiper, not illustrated, wipes the discharge port face 1021 in step B11, the preliminary discharge is performed in step B12. Then, the normal suction ends. With the print head 102 covered with the cap 26, the air release valve 601 may be opened so that the inside of the cap 26 can be communicated to the atmosphere.

The normal suction is performed for purposes of discharging of bubbles from the nozzles and filling of ink to the nozzles and the ink common liquid chamber 105, for example.

After the normal suction is performed, a charge suction is performed. First, the CPU 700 in step B13 determines whether a charge suction execution instruction has an ON state or not. If the charge suction execution instruction has an OFF state, the CPU 700 exits the sequence. If the charge suction execution instruction has an ON state, the processing moves to step B14 and subsequent steps. Until step B14 and step B15, the CPU 700 performs the capping to seal the air release valve 601 like the step B02 and step B03 in the normal suction. Next, because the charge suction uses the charge valve 602, the CPU 700 closes the charge valve 602 in step B16. In step B17, the CPU 700 rotates the pump 25, and the tube 606 disposed between the pump 25 and the charge valve 602 acquires a depressurized space to charge negative pressure. The charge pressure in this case is controlled based on a predetermined number of rotations and a predetermined rotation speed of the roller 605. After that, in step B18, the CPU 700 stops the rotation of the pump 25 and finishes the charging of negative pressure. In step B19, the charge valve 602 is opened to suck ink from the print head 102 (charge suction).

In step B20, the CPU 700 opens the air release valve 601 so that the inside of the cap 26 can be communicated to the atmosphere. After that, in step B21, the CPU 700 starts rotation of the pump 25 and performs idle suction on ink staying within the cap 26. Then, in step B22, the rotation of the pump 25 is stopped to finish the idle suction. The processing in step B23 to step B25 is the same as the processing in step B10 to step B12 in the normal suction. After the preliminary discharge is finished in step B25, the charge suction is completed, and the recovery operation is entirely finished.

Because the charge suction uses negative pressure charged by using the charge valve 602, larger negative pressure is applied on the print head 102 than that of the normal suction. Thus, even with 1-pl nozzles having a small nozzle diameter and a liquid surface having a large meniscus, bubble discharging and ink filling can be performed sufficiently. Having described that one normal suction and one charge suction are performed according to this embodiment, the present disclosure is not limited thereto. A plurality of normal suctions and charge suctions may be performed such as N (N≥1) normal suctions and M (M≥1) charge suctions.

These recovery operations are performed before a printing operation is performed. According to this embodiment, whether a normal suction is to be performed or not and whether a charge suction is to be performed or not is controlled in accordance with whether 1-pl nozzles are to be used in the printing mode received from the host apparatus or not. In other words, one is selected from four cases where both of a normal suction and a charge suction are to be performed, where only a normal suction is to be performed, where only a charge suction is to be performed, and where no recovery operation is to be performed. This control over the recovery operation will be described with reference to FIG. 12. More specifically, in a case where a recovery operation is to be performed before a printing operation in a printing mode without using 1-pl nozzles is performed, only a normal suction is performed without performing a charge suction. On the other hand in a case where a recovery operation is to be performed before a printing operation in a printing mode using 1-pl nozzles is performed, both of a normal suction and a charge suction are performed or only a charge suction is performed.

These controls over the recovery operation are controlled with two flags. A first flag is the recovery request flag and is set to have an ON state in a case where a recovery operation including a normal suction is to be performed under the conditions illustrated in FIGS. 8, 9, and 10. The recovery request flag is set to have an OFF state when a normal suction is performed. A second flag is a charge flag (second flag) and is set to have an ON if a charge suction is to be performed. The charge flag is set to have an OFF state when a charge suction is performed. Here, the charge flag is configured to be turned on when the recovery request flag is turned on through these flags are set to have an ON state or an OFF state independently from each other. Hereinafter, controls with those two flags will be described in detail.

First, if receiving a print instruction from a host apparatus in step A01, the CPU 700 determines whether the received printing mode uses 1-pl nozzles or not in step A02. The type of nozzles to be used may be determined based on the type of recording medium 14 (FIG. 13), arrangement of ink droplets (dots) defined by a combination of the recording medium 14 and an image quality mode (FIGS. 14A and 14B), information regarding nozzles to be heated and so on.

If it is determined in step A02 that the received printing mode uses 1-pl nozzles, the processing moves to step A03 where the CPU 700 determines whether the recovery request flag has an ON state or not. The recovery request flag is set to have an ON in a case where the ink tank 101 is replaced, a case where an elapsed time from the previous recovery operation exceeds a predetermined time, or a case where the number of dots used in a printing operation after the previous recovery operation is performed is equal to or higher than a predetermined value, as illustrated in FIGS. 8 to 10. Information regarding the recovery request flag is stored in the non-volatile memory 704. When two or more recovery request flags have an ON state, the CPU 700 executes a recovery operation having the highest strength between them. The length of a suction time period and suction pressure to be set depend on the condition for turning on the recovery request flag. A recovery operation may be performed in accordance with the flag requesting a recovery operation with the highest so that all of the recovery request flags can be turned off.

If it is determined in step A03 that the recovery request flag has an ON state, the CPU 700 in step A04 turns on the normal suction execution instruction and the charge suction execution instruction. In step A05, the CPU 700 performs a recovery operation including both of a normal suction and a charge suction by following the flowchart illustrated in FIG. 11. Then, in step A06, the CPU 700 turns off the recovery request flag and the charge flag. In step A07, because a normal suction has been performed in step A04, the CPU 700 resets the elapsed time from the previous recovery operation and also resets the dot count values for the nozzles. After that, in step A19, the CPU 700 starts a printing operation.

If it is determined in step A03 that the recovery request flag does not have an ON (or has an OFF state), the CPU 700 in step A07 determines whether the charge flag has an ON state or not. If it is determined in step A07 that the charge flag has an ON state, the CPU 700 in step A09 turns off the normal suction execution instruction and turns on the charge suction execution instruction. According to these execution instructions, only a charge suction is performed in step 10 without performing a normal suction, and the charge flag is turned on in step A11. After that, in step A19, the CPU 700 starts a printing operation. On the other hand, if it is determined in step A08 that the charge flag does not have an ON state (or has an OFF state), the CPU 700 starts a printing operation in step A19 without performing a normal suction and a charge suction.

If it is determined in step A02 that the received printing mode does not use 1-pl nozzles, the CPU 700 in step A12 determines whether the recovery request flag has an ON state or not. It if is determined in step A12 that the recovery request flag has an ON state, the CPU 700 in step A13 turns on the normal suction execution instruction and turns off the charge suction execution instruction. The CPU 700 in step A14 performs only a normal suction without performing a charge suction and in step A15 turns off the recovery request flag and turns on the charge flag. Thus, information regarding a charge suction that is not performed can be managed based on the flags. Because a normal suction is not performed in step A14, the elapsed time from the previous recovery operation is reset in step A16, and the dot count values for the nozzles are reset. After that, in step A19, a printing operation is started.

If it is determined in step A12 that the recovery request flag does not have an ON state (or has an OFF state), the CPU 700 in step A17 determines that the charge flag has an ON state or not. If it is determined in step A17 that the charge flag has an ON state, the CPU 700 in step A18 keeps the charge flag having an ON state and in step A17 starts a printing operation. If it is determined in step A17 that the charge flag does not have an ON state (or has an OFF state), the CPU 700 in step A19 starts a printing operation.

Next, methods for determining the received printing mode uses 1-pl nozzles or not will be described with reference to FIG. 13 and FIGS. 14A and 14B. FIG. 13 illustrates a determination method based on the type of recording medium selected for printing. Some types of recording medium support limited types of nozzles to be used. For example, in a case where plain paper is used as a recording medium, 5-pl nozzles are used to print an image, and 1-pl nozzles are not used. On the other hand, in a case where special paper such as glossy paper is used, the printing apparatus 1 uses both of 5-pl nozzles and 1-pl nozzles to print an image. Thus, the type of nozzles also depends on the type of recording medium. The printing apparatus 1 performs these determinations by reading information regarding the selected type of recording medium added in a header of print data, for example. From the information, the CPU 700 can determine whether the received printing mode uses 1-pl nozzles or not.

FIGS. 14A and 14B illustrate a determination method based on an arrangement of ink droplets (dots) defined by a combination of a type of recording medium and an image quality mode. According to this embodiment, an arrangement of dots (or dot arrangement) is defined based on a combination of a type of recording medium and an image quality mode so that which dot arranges uses which nozzles can be determined. For example, it is determined from FIG. 14A that plain paper/normal mode is selected under RECORDING MEDIUM/IMAGE QUALITY MODE is associated with a dot arrangement A, and it is determined from FIG. 14B that the dot arrangement A uses 5 pl nozzles.

Therefore, when a user selects a type of recording medium and an image quality mode and a print instruction is input, the CPU 700 can acquire information regarding the nozzles to be used based on the combination of the type of recording medium and the image quality mode. The printing apparatus 1 may read print data having a header containing the information to determine whether the received printing mode uses 1-pl nozzles or not.

Figure 15:
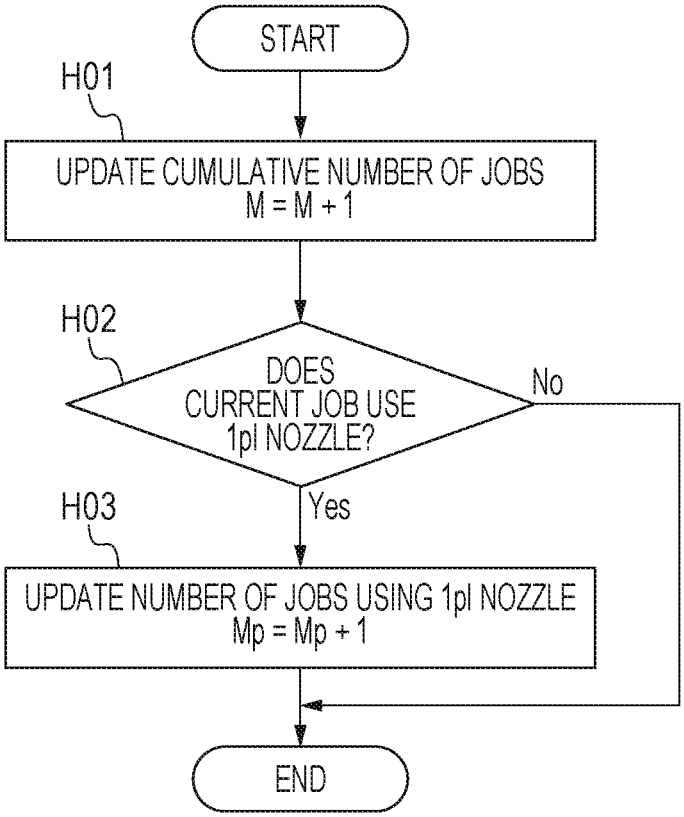
FIG. 15 is a flowchart illustrating a control over a recovery operation after a printing operation completes according to the first embodiment of the subject disclosure.

FIG. 15 is a flowchart illustrating a control over a recovery operation after a printing operation is completed according to this embodiment. Hereinafter, one print instruction received from the host apparatus is counted as 1 job, and, when a printing operation for 1 job completes, the control illustrated in FIG. 15 is performed. One printing mode is applied for 1 job according to this embodiment even though the printing is performed on a plurality of pages. For example, when a job for four pages is received, the same nozzles are used because an identical printing mode is applied for the four pages.

Figure 12:
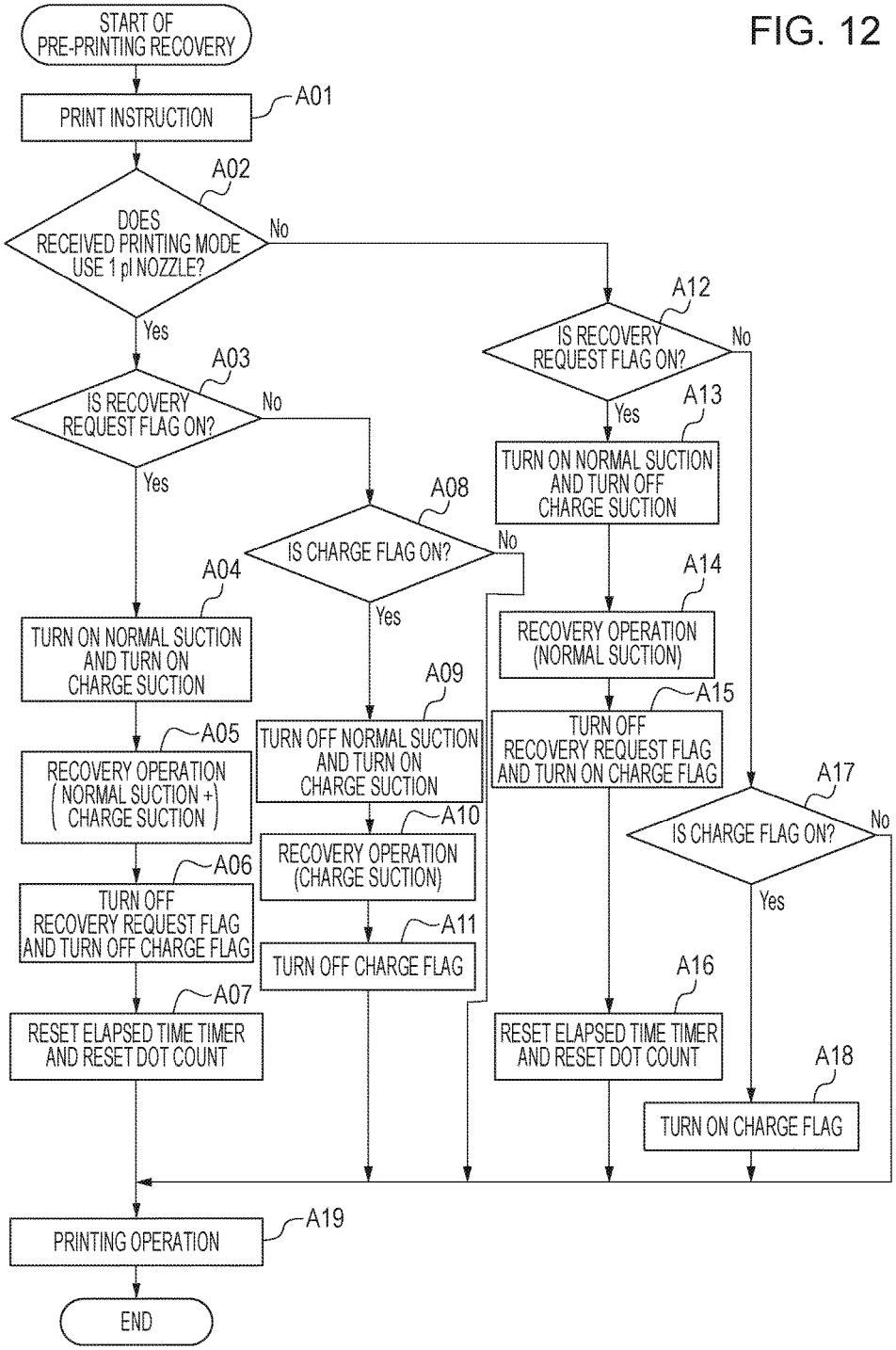
FIG. 12 is a flowchart illustrating a control for the recovery operation according to the first embodiment.

First, in step H01, the CPU 700 adds 1 to a cumulative number of jobs (total number of jobs) M (M=M+1), and the cumulative number of jobs M is updated. In step H02, the CPU 700 determines whether the current job uses 1-pl nozzles or not. The determination here may be based on the determination result provided in step A02 in FIG. 12 illustrating a control before a printing operation is performed. If it is determined in step H02 that 1-pl nozzles are used, the CPU 700 in step H03 adds 1 to a number of 1-pl-nozzle used jobs Mp (Mp=Mp+1). If it is determined in step H02 that 1-pl nozzles are not used, the CPU 700 exits the sequence. Here, the cumulative number of jobs M and number of 1-pl-nozzle used jobs Mp having undergone the additions in this processing are decompressed in the RAM 702 and are stored in the non-volatile memory 704 when the printing apparatus 1 is powered off. When the printing apparatus 1 is powered on next, the CPU 700 decompresses both of the cumulative number of jobs M and the number of 1-pl-nozzle used jobs Mp from the non-volatile memory 704 to the RAM 702.

Figure 16:
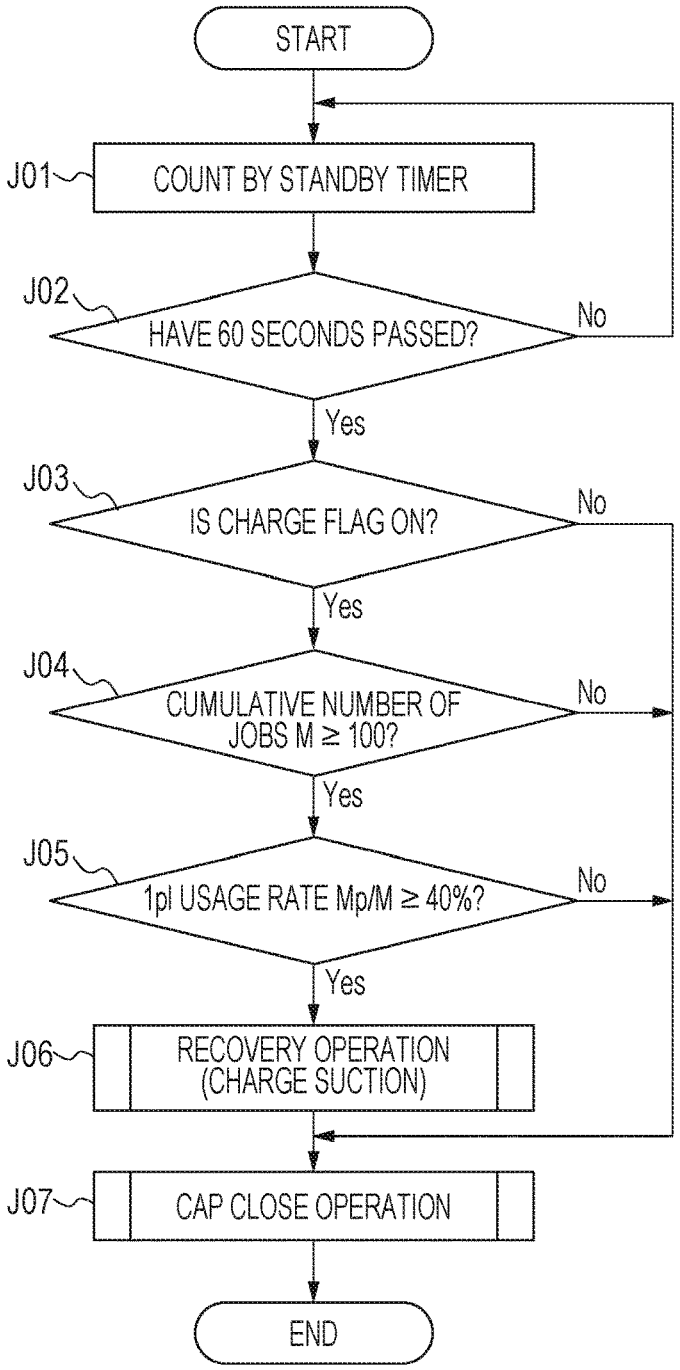
FIG. 16 is a flowchart illustrating a control to be performed when the printing apparatus has a standby state according to the first embodiment of the subject disclosure.

FIG. 16 is a flowchart illustrating a control to be performed when the printing apparatus 1 has a standby state. When the printing apparatus 1 has a standby state, a printing operation is not performed. First, when a printing operation ends, the CPU 700 in step J01 resets a standby timer to 0 and newly starts counting. In step J02, the CPU 700 determines whether the count in the standby timer exceeds 60 seconds or not. If it does not exceed 60 seconds, the counting in the standby timer continues. If it exceeds 60 second, whether the charge flag has an ON state or not is determined in step J03. If the charge flag has an ON state, the CPU 700 in step J04 determines whether the cumulative number of jobs M is equal to or higher than 100 or not. In other words, the CPU 700 here determines whether the cumulative number of jobs M exceeds the number of samples from which a user's tendency can be statistically determined or not. If it is determined in step J03 that the charge flag has an OFF state, the processing moves to step J07 where cap close operation is performed.

If it is determined in step J04 that the cumulative number of jobs M is equal to or higher than 100, the CPU 700 in step J05 determines whether a ratio Mp/M (1-pl usage ratio) of the number of 1-pl-nozzle used jobs Mp and the cumulative number of jobs M is equal to or higher than 40% or not. If Mp/M is equal to or higher than 40%, the CPU 700 determines that there is a high possibility that the next printing operation will use 1-pl nozzles and executes a sequence for a recovery operation (step J06). The recovery operation here performs only a charge suction without performing a normal suction because the recovery request flag has an OFF state and the charge flag has an ON state. A charge suction is performed in advance (advance suction operation) after a printing operation completes as described above. On the other hand, if it is determined in step J04 that the cumulative number of jobs M is lower than 100, the number of samples is not sufficient, and it is difficult to statistically determine a user's tendency. Therefore, a recovery operation (advance suction operation) is not performed, and the processing moves to step J07 where a cap close operation is performed. If it is determined in step J05 that the 1-pl usage ratio Mp/M is lower than 40%, the CPU 700 determines that there is a low possibility that the next printing operation will use 1-pl nozzles. Then, a recovery operation (advance suction operation) is not performed, and the processing moves to step J07 where a cap close operation is performed.

Figure 17:
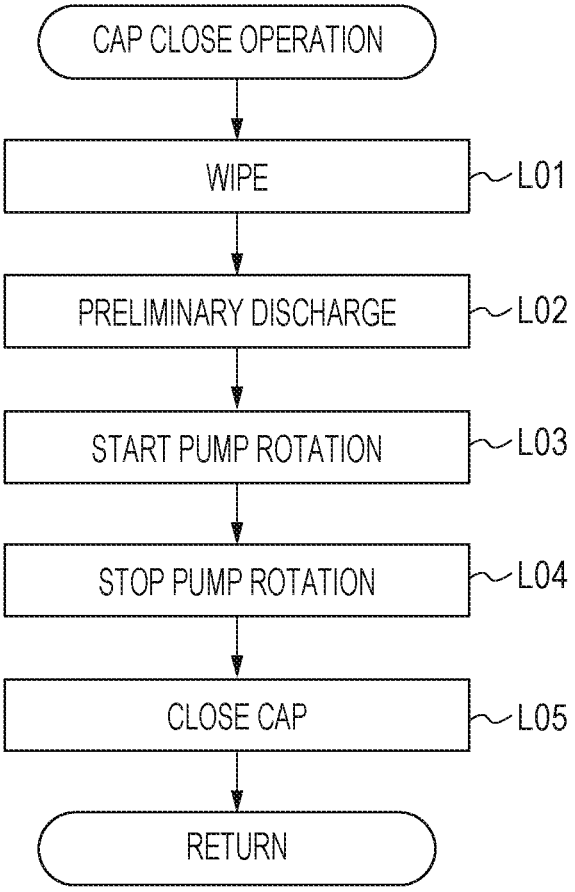
FIG. 17 is a flowchart illustrating a cap close operation according to the first embodiment of the subject disclosure.

FIG. 17 is a flowchart illustrating the cap close operation. First, in step L01, the CPU 700 performs wiping on the discharge port face 1021. Next, in step L02, preliminary discharge is performed from the discharge port 107. In step L03, the CPU 700 drives the pump 25 to discharge ink within the tube 606 disposed between the cap 26 and a waste-ink absorber, not illustrated, and, in step L04, stops the driving of the pump 25. Finally, in order to prevent ink from being adhered due to eater evaporation from the discharge port 107, the print head 102 is covered with the cap 26 in step L05, and the sequence ends.

Figure 18:
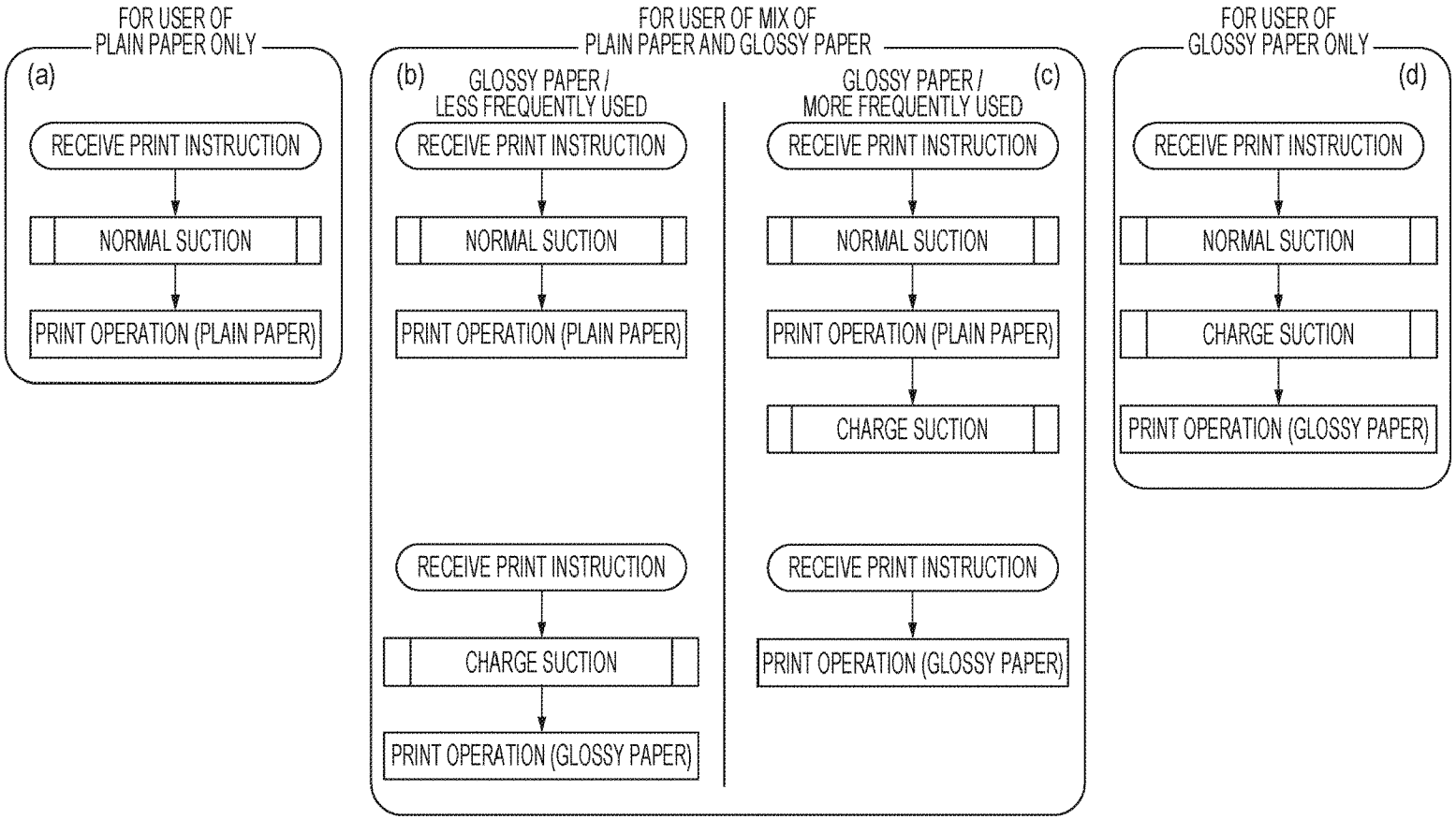
FIG. 18 illustrates diagrams for use in describing an effect for each usage tendency of a user according to the first embodiment of the subject disclosure.

Effects acquired by performing these controls will be described with reference to FIG. 18. First, referring to (a), for a user requesting to print by using plain paper only, a recovery operation including a normal suction only is performed before a printing operation on plain paper is performed, and a charge suction is not performed. This can eliminate the necessity for charge suction operation and can improve the throughput up to the start of a printing operation. This further reduces waste liquid of ink. Next, referring to (d), for a user requesting to print by using glossy paper only, a recovery operation including both of a normal suction and a charge suction is performed before a printing operation is performed on glossy paper. Thus, 5-pl nozzles and 1-pl nozzles can be recovered sufficiently before a printing operation.

On the other hand, referring to (b), for a user requesting to use both of plain paper and glossy paper where the usage ratio of plain paper is higher than the usage ratio of glossy paper, a normal suction is only performed before printing operation is performed on plain paper, and a charge suction is not performed. On the other hand, a charge suction is performed before printing operation is performed on glossy paper, and a normal suction is not performed until the condition for turning on the recovery request flag is satisfied. Therefore, an appropriate suction operation can be selected based on the discharge port 107 to be used for a printing operation. This can improve the throughput to start of a printing operation in a printing mode and can reduce waste liquid of ink.

On the other hand, referring to (c), for a user requesting to use both of plain paper and glossy paper where the usage ratio of glossy paper is higher than the usage ratio of plain paper, a normal suction is only performed before a printing operation is performed on plain paper, and a charge suction (advance suction operation) is performed after the printing operation completes. Thus, because the charge flag has an OFF state before the next printing operation, a charge suction is not performed immediately before the next printing operation. In a case where the printing operation is to be performed on glossy paper, the waiting time up to start of the printing operation can be reduced. Thus, also for a user requesting to use both of plain paper and glossy paper where the usage ratio of glossy paper is higher than the usage ratio of plain paper, the throughput up to start of the printing operation performed on glossy paper can be improved. In a case where a charge suction(advance suction operation) is performed after a printing operation completes and the recovery request flag is then turned on by satisfying the condition for turning on the recovery request flag, a normal suction and a charge suction are performed in response to a glossy paper print instruction.

As described above, in the printing apparatus 1 performing a recovery operation in which the two types of suction are normally performed in series, a control over the recovery operation omitting one of the types of suction can be performed based on a result of determination on whether the printing mode uses 1-pl nozzles or not. This can reduce the recovery operation time period before a printing operation is started in accordance with the received printing mode without using 1-pl nozzles and can improve the throughput. For a user requesting to perform both of printing on plain paper and printing on glossy paper, a use frequency is calculated based on use history (history information) up to the current point so that a charge suction can be performed before a print instruction for the next printing operation is received. This advance suction operation executes a charge suction in advance after the previous printing operation completes and therefore eliminates the necessity for performing a charge suction after a print instruction for the next printing operation is received and can improve the throughput until the printing operation starts. So-called learning control may be performed so that appropriate suctions can be performed in accordance with various ways of use of the apparatus by users.

According to this embodiment, it is configured to perform a charge suction after a normal suction is performed. However, embodiments of the present disclosure are not limited thereto, but the order of a normal suction and a charge suction may be reversed. Having described that, according to this embodiment, the control over a recovery operation is performed based on two types of flag including a flag indicating whether the recovery operation is necessary or not and a flag indicating whether a charge suction is to be performed or not, for example, embodiments may control based on other information. For example, the control may be performed based on two types of a flag indicating whether a normal suction is to be performed or not and the flag indicating whether a charge suction is to be performed or not.

The print head 102 according to this embodiment has two types of discharge port array 106 having different nozzle diameters. However, the print head 102 may have three types of discharge port array 106 having different nozzle diameters.

According to this embodiment, a ratio of the number of 1-pl-nozzle used jobs Mp and the cumulative number of jobs M in the past are adopted as a parameter for determining whether 1-pl nozzles are to be used in the next printing operation or not. However, the ratio may be calculated based on the number of pages produced by using 1-pl nozzles. Having described that, according to this embodiment, the 1-pl usage ratio is calculated based on all of the past print data, it may be configured such that the 1-pl usage ratio may be calculated based on print data during a predetermined period in consideration of a possibility that a user's tendency of use may change halfway. According to this embodiment, a control is performed when the cumulative number of jobs exceeds 100, for example. However, a control may be performed when the 1-pl nozzle usage ratio exceeds a threshold value independently from the count value for the cumulative number of jobs.

Having described that, according to this embodiment, a threshold value is provided for determination on the ratio of the number of 1-pl-nozzle used jobs Mp to the cumulative number of jobs M, embodiments of the present disclosure are not limited. A predetermined threshold value may be provided for determination regarding the number of 1-pl-nozzle used jobs Mp.

Having described that the control according to this embodiment updates the cumulative number of jobs M and the number of 1-pl-nozzle used jobs Mp after a printing operation completes, but the update may be performed before a printing operation starts. Having described that a recovery operation is performed which perform a charge suction after a lapse of a predetermined time (60 seconds) from completion of a printing operation, the recovery operation may be performed immediately after a printing operation completes or after a lapse of a predetermined time from completion of a cap close operation.

Second Embodiment

Figure 19:
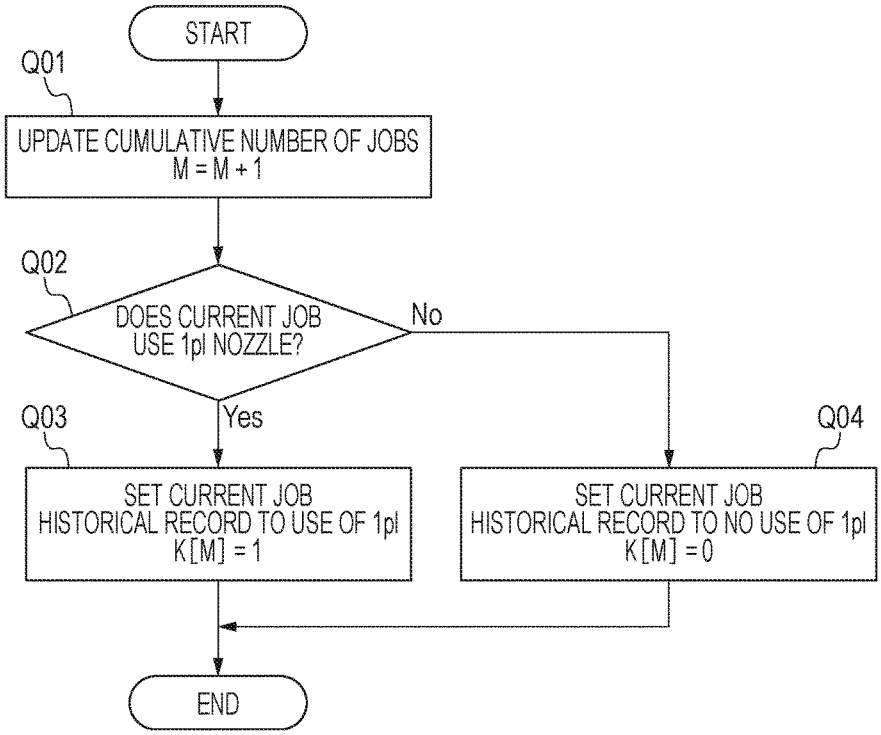
FIG. 19 is a flowchart illustrating a control over a recovery operation after a printing operation completes according to a second embodiment of the subject disclosure.

FIG. 19 is a flowchart illustrating a control over a recovery operation to be performed after a printing operation completes according to a second embodiment. According to the second embodiment, a control is performed by using the number of jobs during a predetermined period, unlike the first embodiment. The basic configuration is the same as that of the first embodiment. In step Q01, 1 is added to a cumulative number of jobs M (M=M+1) to update the cumulative number of jobs M. In step Q02, whether the current job uses 1-pl nozzles or not is determined. The control up to this point is the same as that of the first embodiment.

If it is determined that the current job uses 1-pl nozzles, the job history K [M] is set to 1 in step Q03. Here, the job history K [M] is a sequence having a cumulative number of jobs M as a variable and storing 1-pl nozzles use history of 100 jobs in response to print instructions from the host apparatus during the latest period. On the other hand, if it is determined that the current job does not use 1-pl nozzles, the job history K [M] is set to 0 in step Q04.

Figure 20:
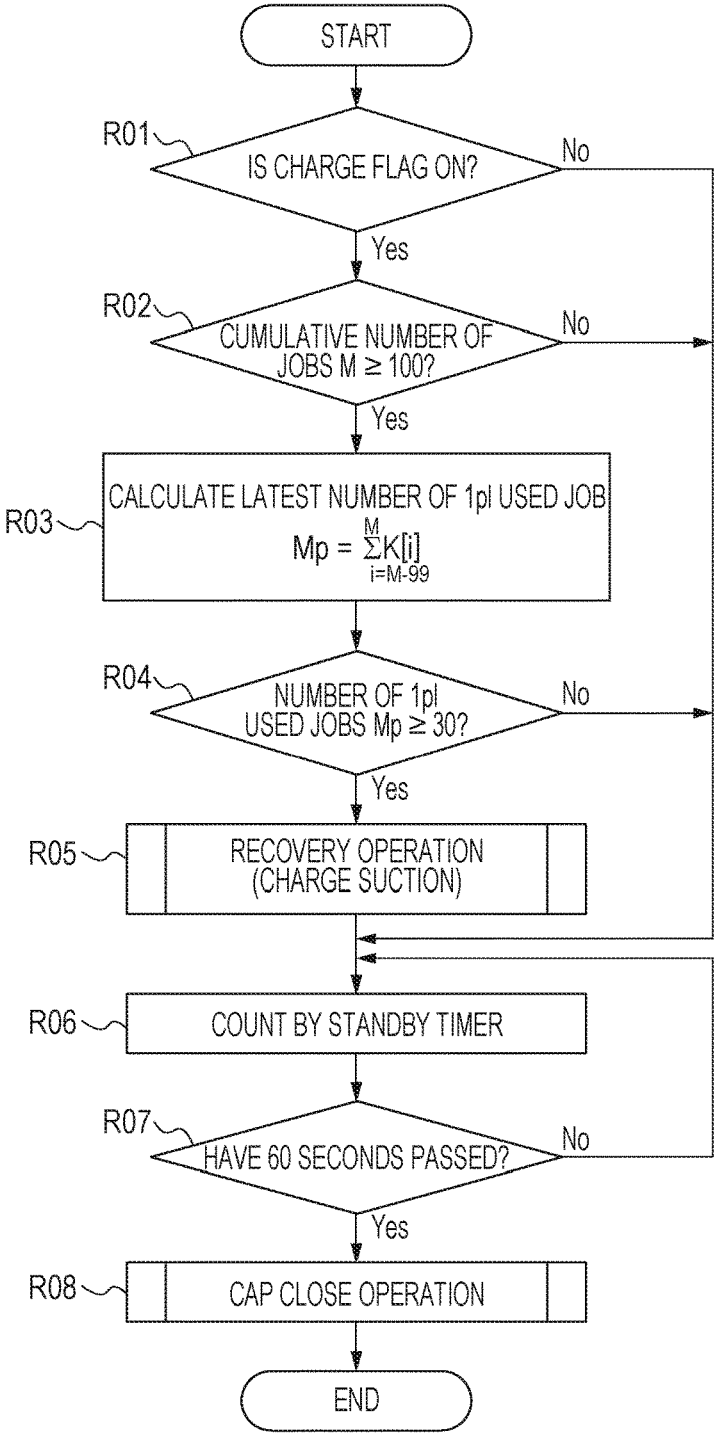
FIG. 20 is a flowchart illustrating a control to be performed when a printing apparatus has a standby state according to the second embodiment of the subject disclosure.

FIG. 20 is a flowchart illustrating a control to be performed when the printing apparatus 1 has a standby state. According to this embodiment, unlike the first embodiment, a recovery operation(advance suction operation) for 1-pl nozzles is performed immediately after a printing operation completes, and the apparatus shifts to have a standby state. First, in step R01, whether the charge flag is set to have an ON state or not is determined. If the charge flag has an OFF state, the processing moves to step R06 without performing a recovery operation.

If the charge flag has an ON state, whether the cumulative number of jobs M is equal to or higher than 100 or not is determined in step R02. Here, also in this embodiment, whether the number of samples from which a user's usage tendency can be determined statistically has been acquired or not is determined. If it is determined in step R02 that the cumulative number of jobs is lower than 100, the user's usage tendency cannot be determined statistically. Therefore, the processing moves to step R06 without performing a recovery operation. If it is determined in step R02 that the cumulative number of jobs M is equal to or higher than 100, the number (Mp) of jobs using 1-pl nozzles among the latest 100 jobs is calculated in step R03. After that, whether the number of jobs using 1-pl nozzles among the latest 100 jobs is equal to or higher than 30 or not is determined in step R04.

If it is determined in step R04 that the number of jobs using 1-pl nozzle is equal to or higher than 30, it is determined that there is a high that possibility the next printing operation will use 1-pl nozzles. In step R05, a sequence of a recovery operation is executed. Here, the recovery operation performs only a charge suction without performing a normal suction because the recovery request flag has an OFF state and the charge flag has an ON state. If it is determined that the number of jobs using 1-pl nozzles is lower than 30, it is determined that there is a low possibility that the next printing operation will use 1-pl nozzles. The processing moves to step R06 without performing a recovery operation.

Next, in step R06, the standby timer starts counting. In step R07, whether the count of the standby timer exceeds 60 seconds or not is determined. If it does not exceed 60 seconds, the standby timer continues counting. If the counting exceeds 60 seconds, the cap close operation illustrated in FIG. 17 is performed in step R08, and the sequence ends. Here, before the standby timer starts counting in step R06, the timer is reset and starts counting from 0.

As described above, a control is performed based on user's use history within a predetermined period limited to the latest 100 jobs to address a case where a user's usage tendency changes in the middle of a usage for a long period of time. This can improve the accuracy of calculation of a use frequency and can reduce the waiting time before a printing operation is performed for a user requesting to print on plain paper and to print on glossy paper. The threshold values to be used for determinations regarding the cumulative number of jobs and the number of jobs using 1-pl nozzles may be determined as required.

Third Embodiment

Figure 21:
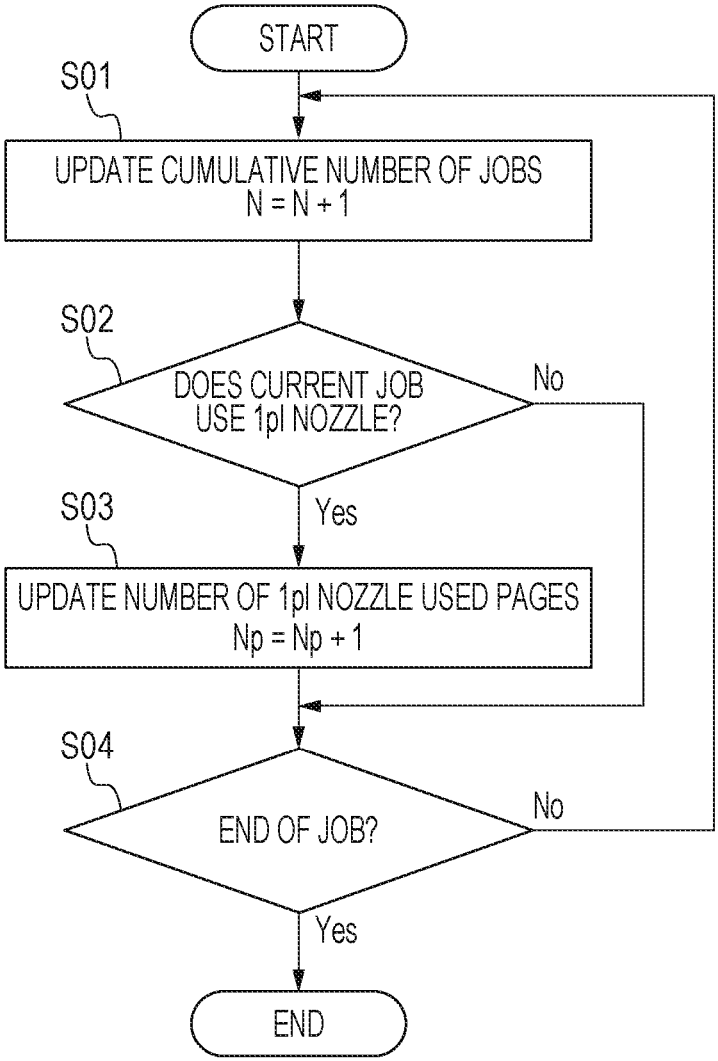
FIG. 21 is a flowchart illustrating a control over a recovery operation after a printing operation completes according to a third embodiment of the subject disclosure.

According to this embodiment, use history of a user is counted based on the number of pages, instead of the number of jobs unlike the first embodiment and the second embodiment. The basic configuration is the same as those of the first embodiment and second embodiment. FIG. 21 is a flowchart illustrating a control over a recovery operation after a printing operation completes according to this embodiment. In step S01, 1 is added to a cumulative number of pages (total number of pages) N (where N=N+1) to update the cumulative number of pages N. In step S02, whether the current printing operation for one page uses 1-pl nozzles or not is determined. If so, 1 is added to the number of 1-pl nozzle used pages Np in step S03 (where Np=Np+1). On the other hand, if it is determined in step S02 that 1-pl nozzles are not used, the processing moves to step S04.

In step S04, whether the printing operation for 1 job has completed or not is determined. If not, the processing returns to step S01 where a printing operation for each page continues. On the other hand, if it is determined in step S04 that the job has completed, the sequence ends.

Figure 22:
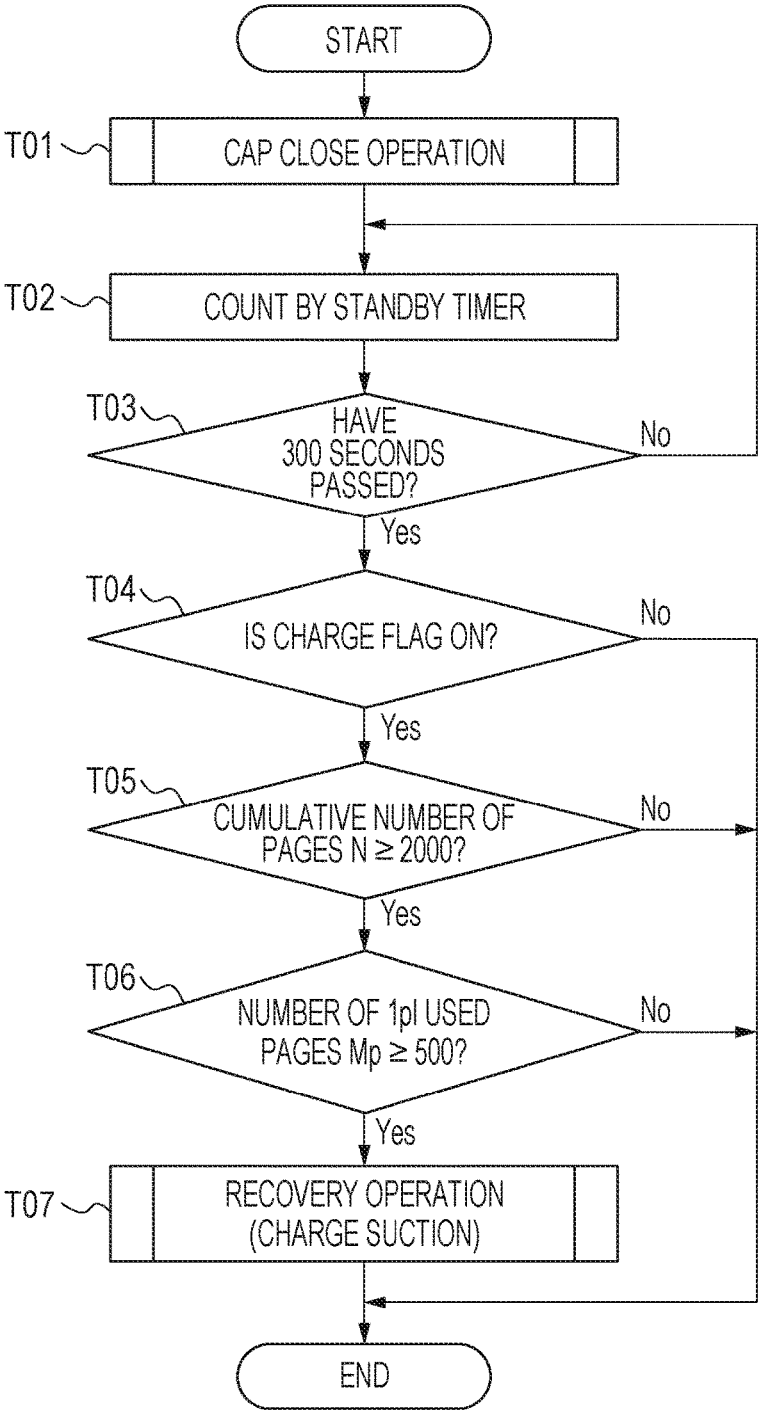
FIG. 22 is a flowchart illustrating a control to be performed when a printing apparatus has a standby state according to the third embodiment of the subject disclosure.

FIG. 22 is a flowchart illustrating a control to be performed when the printing apparatus 1 has a standby state. According to this embodiment, a charge suction is executed under a condition after a cap close operation subsequent to printing completes, unlike the first and second embodiments. First, in step T01, the cap close operation illustrated in FIG. 17 is executed. Next, in step T02, the standby timer starts counting after reset. In step T03, whether the count of the standby timer exceeds 300 seconds or not is checked. If the count does not exceed 300 seconds, the standby timer continues counting.

If the count of the standby timer exceeds 300 seconds, whether the charge flag has an ON or not is determined in step 104. If the charge flag has an OFF state, the sequence ends without performing a recovery operation. If the charge flag has an ON state, whether the cumulative number of pages N is equal to or higher than 2000 or not is determined in step T05. In other words, whether the number of pages N exceeds the number of samples from which a user's usage tendency can be statistically determined or not is checked. If it is determined in step T05 that the cumulative number of pages N is lower than 2000, the sequence ends without performing a recovery operation because a user's usage tendency cannot be statistically determined.

If the cumulative number of pages N is equal to 2000, whether the number of 1-pl used pages Np is equal to or higher than 500 or not is determined in step T06. If it is determined in step T06 that the number of 1-pl nozzle used pages Np is equal to or higher than 500, it is determined that there is a high possibility that the next printing operation will use 1-pl nozzles. Then, a recovery operation is performed in step T07. Because the recovery request flag has an OFF state and the charge flag has an ON state, the recovery operation here performs a charge suction (advance suction operation) only without performing a normal suction. If it is determined in step T06 that the number of 1-pl used pages Np is lower than 500, it is determined that there is a low possibility that the next printing operation will use 1-pl nozzles. Then, the sequence ends without performing a charge suction.

According to this embodiment, as described above, if the cumulative number of pages exceeds a predetermined number and if the number of 1-pl nozzle used pages exceeds a predetermined number, and when the charge flag has an ON state after a subsequent printing operation, a charge suction is performed in advance after the printing operation completes. In other words, if the ratio of the number of 1-pl used pages to the cumulative number of pages exceeds a predetermined value, a charge suction is performed after the current printing operation completes and before a print instruction for the next printing operation is received. This can reduce the time for the recovery operation before the next printing operation, which can improve the throughput. A use frequency of a user may be calculated based on the number of actually printed pages so that more appropriate recovery operation can be performed. Because the number of actually printed pages may vary among jobs, counting based on the number of pages can contribute to more accurate calculation of a use frequency.

According to this embodiment, whether 1-pl nozzles have been used or not is determined for each printing of one page. However, the determination may be based on other information. For example, in a case where one printing mode is used for one job, the number of actually printed pages may be counted for each job to determine whether the printing mode uses 1-pl nozzles or not for each job. Having described the control to be performed after the cumulative number of pages exceeds 2000 according to this embodiment, the control may be performed if the number of 1-pl nozzle used pages exceeds a threshold value without counting for the cumulative number of pages.

Fourth Embodiment

According to the first embodiment, a charge valve is provided, and a recovery operation performs a normal suction and a charge suction. According to a fourth embodiment, a printing apparatus 1 is provided which has no charge valve and in which a recovery operation performs two types of normal suction. An example will be described in which one or more recovery operations can be omitted in a printing mode not using 1-pl nozzles in the printing apparatus 1 which performs two types of normal suction in a recovery operation according to this embodiment.

Figure 23:
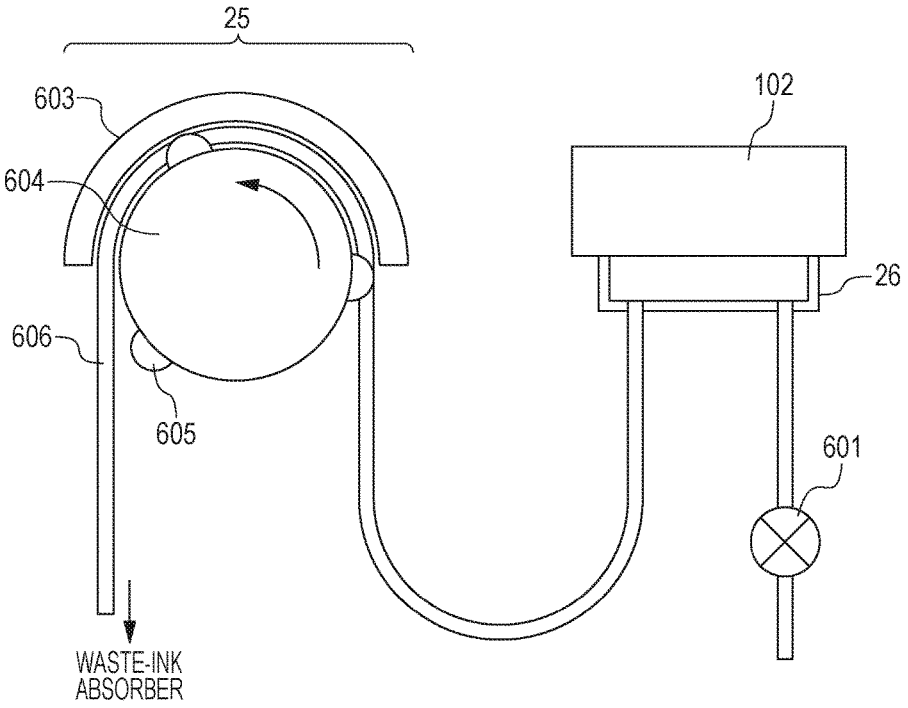
FIG. 23 is a schematic diagram illustrating a suction unit according to a fourth embodiment of the subject disclosure.
Figure 24:
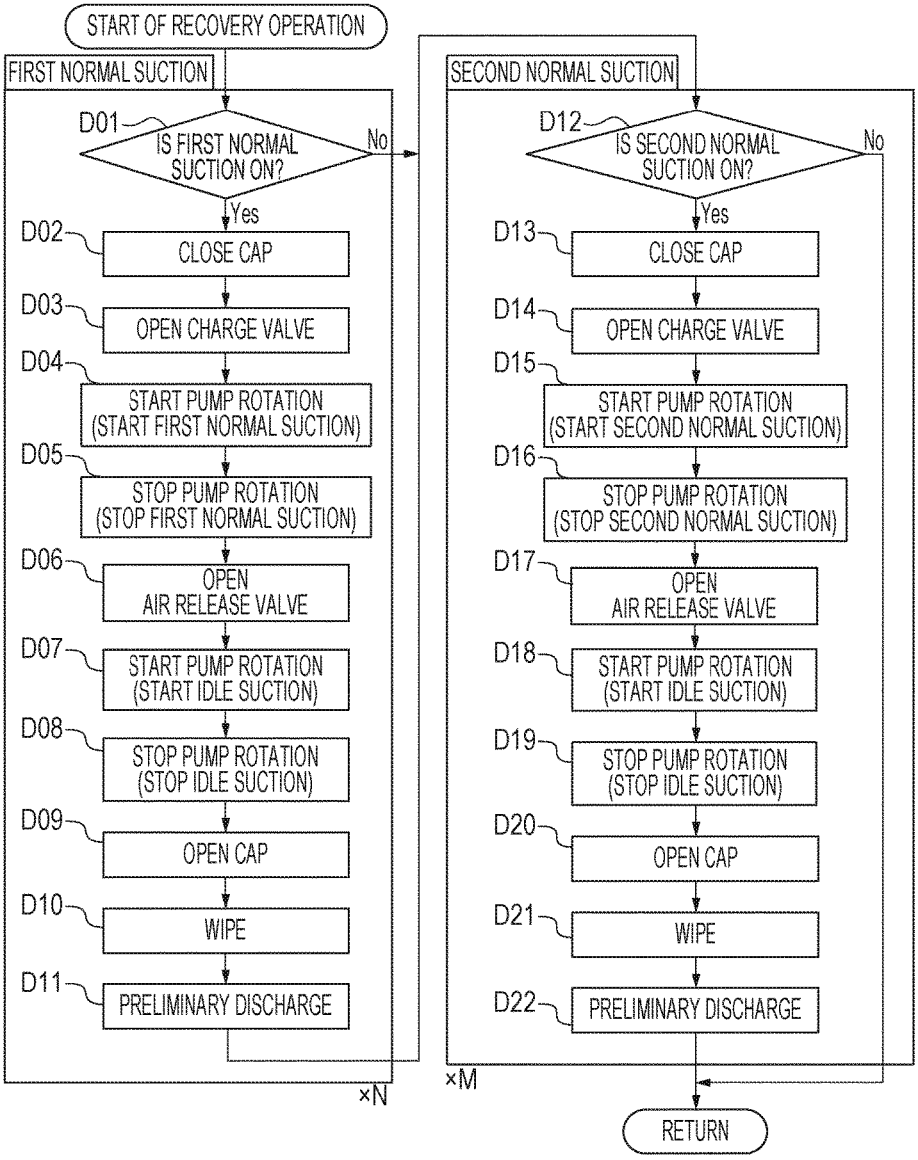
FIG. 24 is a flowchart illustrating a recovery operation according to the fourth embodiment of the subject disclosure.

FIG. 23 illustrates a suction unit without the charge valve 602 in FIG. 6 according to the first embodiment. FIG. 24 is a flowchart illustrating control processing over a recovery operation according to this embodiment. Here, a first normal suction is a recovery operation which recovers 5-pl nozzles and which is not omitted even in a case where the received printing mode does not use 1-pl nozzles. A second normal suction subsequent thereto is a recovery operation which recovers 1-pl nozzles and which can be omitted in a case where the received printing mode is a mode without using 1-pl nozzles.

Also according to this embodiment, these recovery operation are controlled based on two flags. A first flag is a recovery request flag and is set to have an ON state in a case where a recovery operation including the first normal suction is to be performed under conditions illustrated in FIGS. 8, 9, and 10. The recovery request flag is set to have an OFF state if a normal suction is performed. A second flag is a second recovery flag and is set to have an ON state in a case where a second normal suction is to be performed. The second recovery flag is set to an OFF state if the second normal suction is performed. Here, though the second recovery flag can be set to an ON or OFF state independently, it is configured that when the recovery request flag is turned on, the second recovery flag is also turned on. The count value for an elapsed time and the dot count value are reset after a recovery operation including the first normal suction is performed. In a case where a recovery operation is performed which performs the second normal suction only and does not perform the first normal suction, the count value for an elapsed time and the dot count value are not reset, and the counting continues. The control using the two flags will be described in detail.

When a recovery operation starts, the CPU 700 in step D01 determines whether a first normal suction execution instruction has an ON state or not. If the first normal suction execution instruction has an OFF state, the processing moves to a second normal suction, which will be described below. If the first normal suction execution instruction has an ON state, the cap 26 is pressed toward the print head 102 to cover the discharge port face 1021 in step D02. Then, in step D03, the air release valve 601 is closed to shut off the communication between the atmosphere and the cap 26. Next, in step D04, the pump 25 starts rotating, and the first normal suction starts. After the CPU 700 rotates the pump 25 by a predetermined number of rotations, the rotation of the pump 25 stops in step D05, and the first normal suction completes. After that, the CPU 700 in step D06 opens the air release valve 601 to communicate the inside of the cap 26 to the atmosphere and in step D07 rotates the pump 25 again to perform idle suction on ink staying within the cap 26. After the pump 25 is rotated by a predetermined number or rotations, and, in step D08, the rotation of the pump 25 stops, and the idle suction stops. Next, the cap 26 covering the print head 102 is separated from the print head 102 in step D09. Then, after the discharge port face 1021 is wiped in step D10, preliminary discharge is performed in step D11, and the first normal suction completes.

After the first normal suction completes, the second normal suction is performed subsequently. In step D12, the CPU 700 determines whether a second normal suction execution instruction has an ON state or not. If the second normal suction execution instruction has an OFF state, the CPU 700 exits the sequence. If the second normal suction execution instruction has an ON state, the processing moves to step D13 and subsequent steps. The processing in steps D13 to D22 in the second normal suction is the same as that of the first normal suction. The second normal suction in D15 sucks with a higher strength than that of the first normal suction such that 1-pl nozzles can be recovered sufficiently. More specifically, the second normal suction is set to have a longer suction time period or a higher suction pressure than that of the first normal suction. As illustrated in FIG. 24, the first normal suction and the second normal suction may be performed a plurality of number of times such as N and M times (N≥1, M≥1), respectively.

Figure 25:
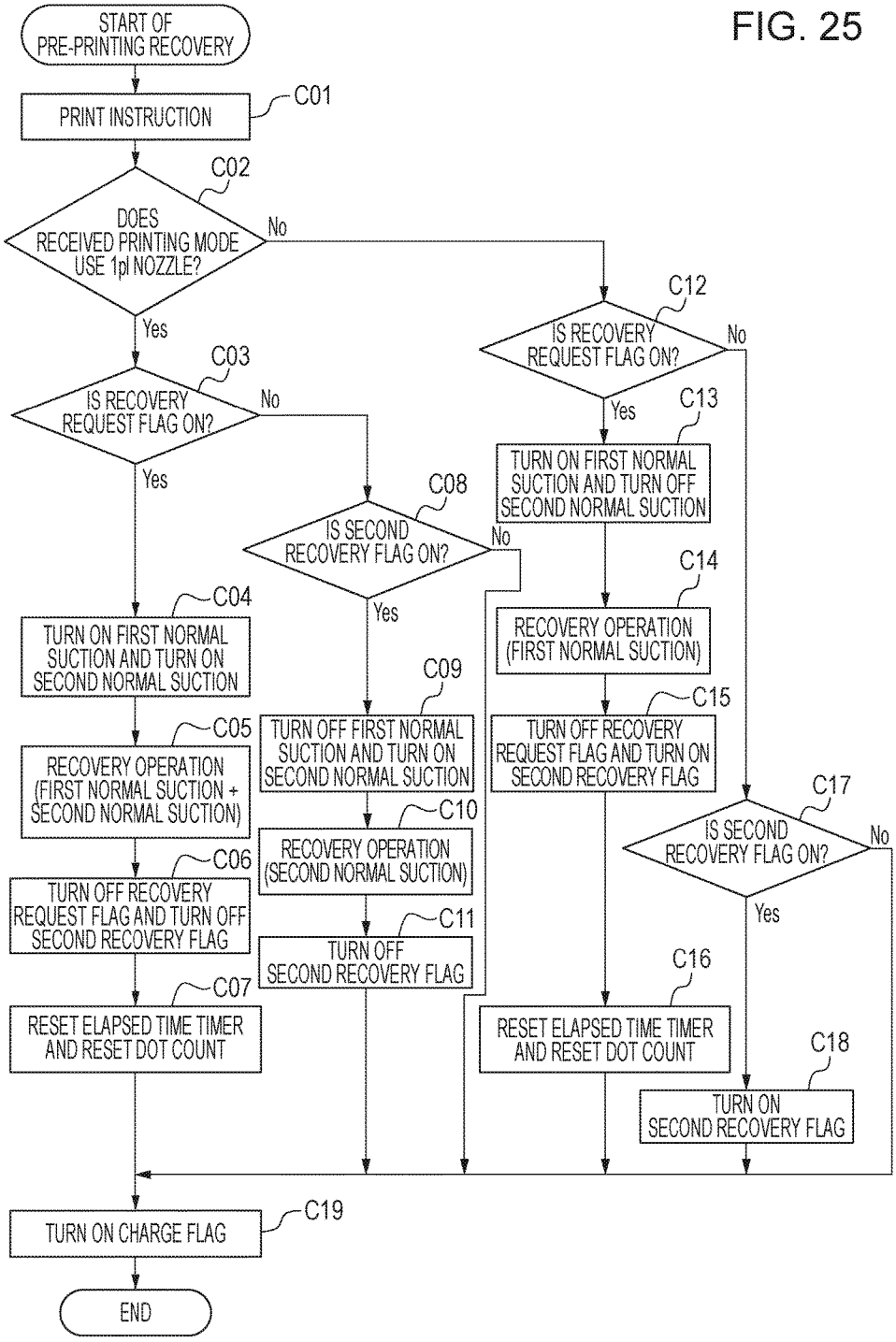
FIG. 25 is a flowchart illustrating a control over a recovery operation according to the fourth embodiment of the subject disclosure.

Next, with reference to FIG. 25, a flow of pre-printing recovery according to this embodiment will be described in a case where a recovery operation performs the first normal suction two times (N=2) and the second normal suction once (M=1), for example. If a print instruction is input in step C01, the CPU 700 determines whether the received printing mode uses 1-pl nozzles or not (step C02). If it is determined that the received printing mode uses 1-pl nozzles, the CPU 700 determines whether the recovery request flag has an ON state or not (step C03).

If it is determined in step C03 that the recovery request flag has an ON state, the CPU 700 in step C04 turns on the first normal suction execution instruction and the second normal suction execution instruction and performs a recovery operation including both of the first normal suction and the second normal suction in step C05. After that, the CPU 700 in step C06 turns offs the recovery request flag and the second recovery flag. This is achieved by the configuration that the second recovery flag is set to have an ON state when the recovery request flag is set to have an ON. Because the first normal suction is performed in step C05, the CPU 700 resets the elapsed time from the previous recovery operation and the dot count value (step C07) and starts a printing operation in step C19.

If it is determined in step C03 that the recovery request flag does not have an ON state (or has an OFF state), the CPU 700 in step C08 determines whether the second recovery flag has an ON state or not. If it is determined in step C08 that the second recovery flag does not have an ON state (or has an OFF state), the processing moves to step C19 to start a printing operation. If it is determined in step C08 that the second recovery flag has an ON state, the CPU 700 in step C09 turns off the first normal suction execution instruction and turns on the second normal suction execution instruction. The CPU 700 does not perform the first normal suction and performs the second normal suction only in the recovery operation performed in step C10 and turns off the second recovery flag in step C11. After that, the processing moves to step C19 to start a printing operation.

If it is determined in step C02 that the received printing mode does not use 1-pl nozzles, the CPU 700 in step C12 determines whether the recovery request flag has an ON state or not. If it is determined in step C12 that the recovery request flag has an ON state, the CPU 700 in step C13 turns on the first normal suction execution instruction and turns off the second normal suction execution instruction. The recovery operation to be performed in step C14 performs a recovery operation including the first normal suction only without the second normal suction. The CPU 700 in step C15 turns off the recovery request flag and turns on the second recovery flag and, in step C16, resets the elapsed time from the previous recovery operation and the dot count value. After that, a printing operation is started in step C19.

If it is determined in step C12 that the recovery request flag does not have an ON state (or has an OFF state), the CPU 700 in step C17 checks whether the second recovery flag has an ON state or not. If it is determined that the second recovery flag has an ON state, the CPU 700 in step C18 keeps the second recovery flag having an ON state, and a printing operation starts in step C19. If it is determined in step C17 that the second recovery flag does not have an ON state (or has an OFF state), the CPU 700 does not perform a recovery operation and starts a printing operation in step C19.

The control according to the first, second, or third embodiment may be performed in the configuration according to this embodiment as described above. In other words, the time point for performing the second normal suction may be controlled based on the ratio of the number of 1-pl nozzle used jobs to the cumulative number of jobs, the ratio of the number of 1-pl nozzle used jobs to the latest 100 jobs, or the ratio of the number of 1-pl nozzle used jobs to the cumulative number of pages. Thus, an appropriate suction operation based on a user's usage tendency can be performed.

In other words, according to the present disclosure, an ink-jet printing apparatus is provided which performs a suction operation or operations in accordance with a discharge port to be used for a printing operation.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An ink-jet printing apparatus comprising:

a print head having a discharge port face provided with a first discharge port having a first diameter and a second discharge port having a second diameter smaller than the first diameter, the print head being configured to perform a printing operation on a recording medium;

a cap configured to cover the discharge port face;

a suction unit connected to the cap, configured to suck ink from the print head when the cap covers the discharge port face, and capable of performing a first suction operation sucking ink at a first strength and a second suction operation sucking ink at a second strength higher than the first strength;

a control unit configured to cause the suction unit to perform the suction operation; and a determining unit configured to determine a printing operation to be performed by the print head among a plurality of printing operations including a first printing operation performing printing on a recording medium using at least the second discharge port and a second printing operation performing printing on a recording medium using the first discharge port without using the second discharge port, wherein, in a case where the determining unit determines to perform the first printing operation, the control unit causes the suction unit to perform the first suction operation and the second suction operation before the first printing operation, and wherein, in a case where the determining unit determines to perform the second printing operation, the control unit causes the suction unit to perform the first suction operation and not to perform the second suction operation before the second printing operation and causes the suction unit to perform the second suction operation after the second printing operation.

2. The ink-jet printing apparatus according to claim 1, wherein the suction unit has a pump configured to suck ink, an on-off valve provided between the cap and the pump and capable of switching between an open state enabling communication between the cap and the pump and a closed state disabling the communication between the cap and the pump.

3. The ink-jet printing apparatus according to claim 2, wherein the first suction operation suctions ink by driving the pump when the on-off valve is in the open state, and the second suction operation suctions ink when the on-off valve is switched to the open state after the pump is driven for a predetermined time when the on-off valve is in the closed state.

4. The ink-jet printing apparatus according to claim 1, wherein the first printing operation is performed by using the first discharge port and the second discharge port.

5. The ink-jet printing apparatus according to claim 1, wherein the cap covers the first discharge port and the second discharge port.

6. A cleaning method for an ink-jet printing apparatus, the ink-jet printing apparatus including:

a print head having a discharge port face provided with a first discharge port having a first diameter and a second discharge port having a second diameter smaller than the first diameter, the print head being configured to perform a printing operation on a recording medium;

a cap configured to cover the discharge port face; and a suction unit connected to the cap, the suction unit being configured to suck ink from the print head when the cap covers the discharge port face, and capable of performing a first suction operation sucking ink at a first strength and a second suction operation sucking ink at a second strength higher than the first strength, the cleaning method comprising:

determining a printing operation to be performed by the print head among a plurality of printing operations including a first printing operation performing printing on a recording medium using at least the second discharge port and a second printing operation performing printing on a recording medium using the first discharge port without using the second discharge port;

in a case where determining to perform the first printing operation, controlling the suction unit to perform the first suction operation and the second suction operation before the printing operation; and in a case where determining to perform the second printing operation, controlling the suction unit to perform the first suction operation before the printing operation without performing the second suction operation and to perform the second suction operation after the second printing operation.

7. The cleaning method for the ink-jet printing apparatus according to claim 6, wherein the suction unit has a pump configured to suck ink, an on-off valve provided between the cap and the pump and capable of switching between an open state enabling communication between the cap and the pump and a closed state disabling the communication between the cap and the pump n.

8. The cleaning method for the ink-jet printing apparatus according to claim 7, wherein the first suction operation suctions ink by driving the pump when the on-off valve is in the open state, and the second suction operation suctions ink when the on-off valve is switched to the open state after the pump is driven for a predetermined time when the on-off valve is in the closed state.

9. The cleaning method for the ink-jet printing apparatus according to claim 6, wherein the first printing operation is performed using the first discharge port and the second discharge port.

10. The cleaning method for the ink-jet printing apparatus according to claim 6, wherein the cap covers the first discharge port and the second discharge port.

* * * * *